US009609925B2

(12) United States Patent
Lenhart

(10) Patent No.: US 9,609,925 B2
(45) Date of Patent: Apr. 4, 2017

(54) FOLDING POLE, IN PARTICULAR FOR NORDIC WALKING

(75) Inventors: Klaus Lenhart, Ohmden (DE); Anna Friederike Lenhart, legal representative, Kirchheim (DE); Markus Sebastian Lenhart, legal representative, Kirchheim (DE)

(73) Assignee: LEKISPORT AG, Baar (CH)

( * ) Notice: Subject to any disclaimer, the term of this patent is extended or adjusted under 35 U.S.C. 154(b) by 559 days.

(21) Appl. No.: 13/983,708

(22) PCT Filed: Feb. 3, 2012

(86) PCT No.: PCT/EP2012/051887

§ 371 (c)(1),
(2), (4) Date: Sep. 30, 2013

(87) PCT Pub. No.: WO2012/104424

PCT Pub. Date: Aug. 9, 2012

(65) Prior Publication Data

US 2014/0069475 A1 Mar. 13, 2014

(30) Foreign Application Priority Data

Feb. 4, 2011 (CH) ..... 218/11

(51) Int. Cl.
*A45B 9/00* (2006.01)
*A45B 9/02* (2006.01)
(Continued)

(52) U.S. Cl.
CPC ..... *A45B 9/00* (2013.01); *A45B 9/02* (2013.01); *A45B 9/04* (2013.01); *A63C 11/221* (2013.01);
(Continued)

(58) Field of Classification Search
CPC ..... A45B 2009/005; A45B 2009/007; A45B 2200/05; A45B 2200/055
See application file for complete search history.

(56) References Cited

U.S. PATENT DOCUMENTS 3,730,544 A 5/1973 Hyman
4,497,092 A 2/1985 Hoshino
(Continued)

FOREIGN PATENT DOCUMENTS

CH 702967 A1 10/2011
CN 101087634 A 12/2007
(Continued)

OTHER PUBLICATIONS

English translation of DE 20211381 U1 from Espacenet.com.*
(Continued)

*Primary Examiner* — David R Dunn
*Assistant Examiner* — Danielle Jackson
(74) *Attorney, Agent, or Firm* — Sughrue Mion, PLLC

(57) ABSTRACT

The invention relates to a folding pole (1), normally comprising four pipe sections (7-9), wherein the pipe sections (7-9) are connected to each other by means of plug-in connections while aligned along the pole axis (32) in the assembled state of the folding pole (1), and normally only three pipe sections (8, 8', 9) are still connected to each other by means of a movable connecting element (16) in the folded state, and wherein a pole handle (2) is arranged on a top pipe section (7) and a pole tip (23) is arranged on a bottom pipe section (9). According to the invention, at least one of the plug-in connections is realized by means of an external clamping mechanism (10), wherein the clamping mechanism (10) is fastened to a first pipe section (7), and wherein a second pipe section (8), which has an outside diameter smaller than or nearly equal to the inside diameter
(Continued)

of the first pipe section (7), and which is supported in the first pipe section (7) so as to be movable itself, can be fastened in the relative axial position by the external clamping mechanism (10). The further plug-in connections are designed as pure plug-in connections, wherein pipe sections (8, 8', 9) are fastened only in an axial direction in the connected state. The pipe sections (7-9) are connected to each other by means of at least one tension cable (16), which is fastened to the bottom pipe section (9) and to the top pipe section (7) and which is arranged so as to pass through the interior (31) of the at least two middle pipe sections (8, 8'). The folding pole (1) is designed in such a way that the folding pole can be transferred from the folded state to the assembled state by connecting the further plug-in connections, and then, with the external clamping mechanism (10) released, pulling the second pipe section (8) out of the first pipe section (7) until the tension cable (16) is under tension, and fastening the external clamping mechanism (10).

29 Claims, 13 Drawing Sheets

(51) Int. Cl.
*A45B 9/04* (2006.01)
*A63C 11/22* (2006.01)

(52) U.S. Cl.
CPC ..... *A63C 11/222* (2013.01); *A63C 11/227* (2013.01); *A45B 2009/005* (2013.01); *A45B 2200/055* (2013.01); *A63C 2203/10* (2013.01)

(56) References Cited

U.S. PATENT DOCUMENTS

| | | | | |
|---|---|---|---|---|
| 5,478,117 | A | 12/1995 | Quintana et al. | |
| 7,690,085 | B2 * | 4/2010 | Lenhart | A63C 11/222 16/436 |
| 2002/0076266 | A1 | 6/2002 | Mandon et al. | |
| 2003/0047203 | A1 * | 3/2003 | Lah | E04H 15/48 135/114 |
| 2008/0041432 | A1 | 2/2008 | Willis | |
| 2008/0149154 | A1 | 6/2008 | Lenhart | |
| 2009/0314320 | A1 | 12/2009 | Heim | |
| 2010/0200032 | A1 | 8/2010 | Lee | |
| 2011/0240078 | A1 | 10/2011 | Lenhart et al. | |
| 2013/0062376 | A1 | 3/2013 | Lenhart | |
| 2013/0068268 | A1 | 3/2013 | Heim | |

FOREIGN PATENT DOCUMENTS

| | | | |
|---|---|---|---|
| CN | 101516228 | A | 8/2009 |
| DE | 694 01 765 | T2 | 10/1997 |
| DE | 297 06 849 | U1 | 8/1998 |
| DE | 297 08 849 | U1 | 8/1998 |
| DE | 202 11 181 | U1 | 12/2003 |
| DE | 10-2007-035754 | A1 | 2/2009 |
| EP | 098 898 | A1 | 1/1984 |
| EP | 1 217 224 | A1 | 6/2002 |
| EP | 1 450 906 | B1 | 6/2005 |
| EP | 2 168 641 | A1 | 3/2010 |
| JP | 2002-136315 | A | 5/2002 |
| JP | 2003-130017 | A | 5/2003 |
| JP | 2003-319808 | A | 11/2003 |
| JP | 2008-104539 | A | 5/2008 |
| JP | 2008-525061 | A | 7/2008 |
| JP | 2010-504117 | A | 2/2010 |
| WO | 2006/066423 | A1 | 6/2006 |
| WO | 2006/066424 | A1 | 6/2006 |
| WO | 2008/037098 | A1 | 4/2008 |
| WO | 2010/085905 | A1 | 8/2010 |
| WO | 2011/128231 | A1 | 10/2011 |

OTHER PUBLICATIONS

English translation of WO 2010/085905 A1 from Espacenet.com.*
English translation of International Report on Patentability, dated Feb. 3, 2012.

* cited by examiner

FOLDING POLE, IN PARTICULAR FOR NORDIC WALKING

CROSS REFERENCE TO RELATED APPLICATIONS

This application is a National Stage of International Application No. PCT/EP2012/051887 filed Feb. 3, 2012, claiming priority based on Swiss Patent Application No. 00218/11 filed Feb. 4, 2011, the contents of all of which are incorporated herein by reference in their entirety.

TECHNICAL FIELD

The present invention relates to the field of poles for hiking, Nordic walking and also in the broadest sense for other types of sports such as cross-country skiing or alpine skiing, mountaineering etc.

PRIOR ART

Pole designs which are adjustable in their length are known in particular but not exclusively from the field of hiking or Nordic walking. The adjustability can be used on the one hand so that the length of the pole can be adjusted matched to the requirements and on the other hand, to reduce the pole to a pack size which is as small as possible, i.e. to configure the length to be reducible in such a manner that the pole can be stowed, for example, in a rucksack or similar. Such designs in which so-called inner pipes having a small diameter are mounted displaceably in an outer pipe having a somewhat larger diameter and in which the relative position of the pipe sections can be fixed by a fixing mechanism are known, for example, from DE 297 06 849 or from DE 497 08 829 or EP 1 450 906.

When using such designs, it is essential that the individual pipe sections have different diameters and it must additionally be ensured that the pipes can also be displaced really extensively into one another in particular in order that the small pack size can be achieved.

It can therefore occur that the pole becomes very thin, in particular in the lower region where the thinnest pipe is typically disposed, and thus for some applications no longer has sufficient intrinsic stiffness, in addition the designs disclosed in these documents are frequently not very much welcomed by the user since the relative position of the individual pole pipe sections must be ensured by twisting these pole pipe sections relative to one another for which appropriate turning forces to be applied manually are required.

Alternative mechanisms in which the relative fixing of the axial position of different pipe sections is not achieved by an interior fixing mechanism are, for example, known from WO 2010/085905 or also from DE 694 01 765 or EP 1 217 224 or EP 098 898, these external designs are however frequently not suitable for mounting more than two pole pipes displaceably into one another with the result that a sufficiently small pack size is not obtained.

DESCRIPTION OF THE INVENTION

It is accordingly inter alia an object of the present invention to provide a constructively simple and therefore robust folding pole which can be folded as small as possible, for example, in order to be stored in a rucksack or a bag.

This object is solved by a folding pole having the features of claim 1.

Specifically the invention is in particular concerned with improving a folding pole having at least three, typically however at least or precisely four pipe sections, where the pipe sections are connected to each other by means of plug-in connections whilst aligned along the pole axis in the assembled state of the folding pole, and at least two or typically at least three or precisely three pipe sections are still connected to each other by means of a movable connecting element, normally in the form of a tension cable, in the folded state.

Typically a pole handle is fastened to an uppermost pipe section and a pole tip is arranged on a lowermost pipe section. In particular but not exclusively the invention is concerned with the improvement of those designs in which the pole handle and/or the pole tip are configured asymmetrically and where the relative rotational position of the pipe sections is therefore relevant.

The invention is in particular either characterised in that at least one of the plug-in connections is achieved by means of an external clamping mechanism, in which the clamping mechanism is fastened to a first pipe section, and in which a second pipe section, which has an outside diameter smaller than or approximately equal to the inside diameter of the first pipe section, and which is supported in the first pipe section so as to be movable itself, can be fixed in the relative axial position by the external clamping mechanism. Or the invention is characterised in that at least one of the plug-in connections is achieved by means of a positive snap-in locking device on the second pipe section, wherein the second pipe section has an outside diameter smaller than or approximately equal to the inside diameter of a first pipe section and can be slid into the first pipe section and can be fixed in the relative axial position by the positive snap-in locking device.

The design according to the invention is furthermore preferably characterised in that the further plug-in connections are configured as pure plug-in connections, in which pipe sections are fixed only in an axial direction in the connected state.

The design according to the invention is furthermore preferably characterised in that the pipe sections are connected to each other by means of at least one tension cable, which is fastened to the lowermost pipe section and is fastened to the uppermost pipe section and which is arranged so as to pass through the interior of the at least two middle pipe sections.

This has the result that the folding pole is configured in such a manner that the folding pole can be transferred from the folded state to the assembled state by connecting the further plug-in connections and then, with the external clamping mechanism released or with the positive snap-in locking device released, pulling the second pipe section out of the first pipe section until the tension cable is under tension, and then fixing the external clamping mechanism or the positive snap-in locking device.

In other words, such a folding pole is normally not configured to be adjustable in its length for use when it has an external clamping mechanism as described above except that the length of the tension cable or the fastening on the tension cable on the respective terminal pipe section is configured to be variable for its part.

The tension cable is used to a certain extent in such a manner that it clamps the lowermost pipe section in the axial direction in relation to the uppermost pipe section and therefore in other words fixes the further plug-in connections, which are only fixed with respect to one another in one axial direction, with respect to one another in the other axial direction. This therefore results in a simple and very robust design which, for example, allows the lower pipe sections which can be connected to one another by means of these further plug connections to be achieved with the same pipe diameters. In contrast to designs in which all the pipe sections are mounted displaceably relatively to one another and inserted into one another, the proposed design therefore also allows designs in which actually, for example, only the uppermost two pipe sections must be configured with different diameters so that the external clamping mechanism can be achieved, but the other pipe sections can have the same diameter. Thus, the material and production costs can be reduced, and in particular the optimal diameter can be used for all lower pipe sections. Whereas otherwise particularly in the lowermost section this results in an inadequate pipe cross-section for many applications, in the present design this is not the case as a result of the plug-in connections. Nevertheless, as is usually also preferred, for example, the lowermost pipe section can naturally be configured to be double-butted.

A first preferred embodiment is characterised in that the first pipe section is the uppermost pipe section and that the second pipe section is the first adjoining middle pipe section downwards. This enables a particularly easy handling, especially as in this design the uppermost pipe sections is then typically that having the largest diameter and the clamping mechanism far above, which then gives an ideal weight distribution along the pole axis. In the case of a positive snap-in locking device for the cable tension, the first pipe section is preferably the uppermost or second uppermost pipe section and the second pipe section is the first adjoining middle pipe section downwards. According to a preferred embodiment, the snap-in locking device preferably comprises a spring-loaded radial locking pin which is preferably held against the action of a spring penetrating in a radial through hole of the second pipe section. The spring element is preferably a leaf spring, e.g. a spring plate to the first end of which the locking pin is advantageously fastened, e.g. riveted. In this case, the second end of the leaf spring preferably projects in a self-restraining manner in a channel of a terminating pin disposed along the pole longitudinal axis. The self-restraint is achieved, for example, by means of a barbed hook which in the case of a spring plate, is disposed at the second end thereof. However, the end of the leaf spring can also be connected to the terminating pin by a different type of fastening or embedded therein. This can be achieved, for example, by overmoulding the leaf spring with the material of the terminating pin or by gluing the leaf spring into the channel provided. The terminating pin is preferably held in the upper section of the second pipe section. According to a particularly preferred embodiment, the terminating pin is pushed with its head into the first pipe section and fastened and has a collar which rests on the upper end of the second pipe section. Preferably, the neck of the terminating pin adjoining the collar at the bottom is pushed into the second pipe section in the overlap region of the first and second pipe section.

A further preferred embodiment is characterised in that the further plug-in connections are configured in such a manner that they are secured in the axial stop position against a relative twisting of the associated pipe sections about the pole axis, preferably by ensuring a positive connection with respect to twisting, which furthermore preferably locks automatically when the plug-in connections are pushed together. This is particularly important when, for example, the pole tip and the pole handle are both configured asymmetrically, i.e. are each configured specifically in the running direction. If plug-in connections are not configured symmetrically and therefore secured against any relative twisting, it cannot be excluded that during use or when the tension on the tension cable is inadequate, the lower plugged-in pipe sections will twist with respect to one another. This is extremely unpleasant for use. In other words, it is ensured by means of this rotationally fixed configuration that the lower pipe sections are secured against rotation relative to one another when they are in the axial stop. The correct relative rotational position of pole tip and pole handle is then set in this design during assembly whereby this rotational position is set correctly when fixing the external clamping mechanism when the tension cable is under tension, i.e. by fixing the rotational position from the uppermost to the second uppermost pipe.

Such a positive connection can be ensured, for example, whereby in the axial stop position, regions of the two connected pipe sections coming in contact are configured asymmetrically about the pole axis where the regions coming in contact preferably comprise substantially axially directed stop faces and/or regions of the plug-in connection coming in contact in the radial direction.

The positive connection can preferably be achieved whereby axially directed stop faces are correspondingly toothed, corrugated, bevelled and/or configured with a transverse pin engaging in one or more grooves.

A further preferred embodiment is characterised in that the pipe sections are dimensioned in such a manner (in particular with regard to length but also in particular with regard to possible insertion depth of the second uppermost pipe section in the uppermost pipe section) that in the assembled state the uppermost middle pipe section can be inserted substantially completely or only apart from a short section into the uppermost pipe section. In the assembled state this results in a situation in which in the case of a folding pole having four pipe sections, the uppermost two are almost completely pushed into one another and the lower two can be arranged loosely and only connected to one another by means of the tension cable, in addition to a certain extent in a zigzag. This results in a minimally small pack size.

According to a further preferred embodiment, the tension cable is fastened to the lowermost pipe section and/or to the uppermost pipe section, by providing an axially fixed retaining element (typically a fastening pin) to which the tension cable is fastened (or is brought into axial contact with this element in the clamped state). This fastening is preferably variable for an adjustable length of the folding pole, whereby this is achieved, for example, by means of a detachable knot (or a terminating pin, a terminating pearl or similar) which is brought into contact with the retaining element in the axial direction in the assembled state. Alternatively it is possible to achieve an adjustable length of the folding pole whereby the length of the tension cable in the middle region is configured to be adjustable.

A further preferred embodiment of the design according to the invention is characterised in that the fastening of the tension cable on the retaining element is configured to be elastically spring-mounted, preferably by providing a spring or an elastic element, e.g. therefore a spiral spring in or on the retaining element, through the interior whereof the tension cable is disposed to run. This spring-mounted configuration has the advantage that the axial tension of the tension cable which is built up during the fixing of the external clamping mechanism is maintained reliably for a long time and does not decrease, for example, when the uppermost two pipe sections are displaced slightly into one another in their relative axial position.

Substantially the same effect can be produced by configuring the tension cable to be somewhat elastic at least in sections, preferably over the entire length in the longitudinal direction.

According to a particularly preferred embodiment, the retaining element comprises a closure element which can be fixed detachably in the upper end of the retaining element. The closure part preferably has an axial through opening for the tension cable.

According to a particularly preferred embodiment, the closure element, which is preferably formed from plastic has a head section and a neck section, where the neck section can preferably be inserted into the upper end of the retaining element, can be screwed in by means of an external threaded hole or can be plugged and locked against rotation by means of a bayonet closure. To this end the retaining element preferably has an inner threaded hole in its upper region. According to a particularly preferred embodiment, the closure element is disposed axially above the spiral spring. A guide element as a stop element is preferably disposed between spiral spring and closure element, which rests with a radial flange on the spiral spring and projects with an axial guide section into the spiral spring. The radial flange of the stop element here serves the closure element as a clear stop or contact surface. The lower cable connection, i.e. the tension cable fastened at the bottom together with guide elements, spiral spring and closure element in this way forms a unit which is easy for the user to remove from the pole pipe. In order to replace the cable, the user releases the closure element from the retaining element, removes the said unit and releases the knot at the lower end of the tension cable. The cable can thus be pulled out from above, preferably through the handle head. A further preferred embodiment of the folding pole proposed here is characterised in that the further plug-in connections are configured in such a manner that on one pipe section they have a guide pin provided with an axially running central through opening for the tension cable (preferably one-piece, consisting of plastic), which is firmly fastened in this pipe section with a fastening section and axially opposite thereto has a pin region which can be slid into the other pipe section, where between fastening section and pin region there is provided a preferably radially circumferential outwardly directed contact flange which in the assembled state is brought into axial contact with the pipe end of the other pipe section and/or with a pipe closure sleeve provided thereon, where preferably this axial stop is configured asymmetrically about the pole axis and/or wherein further preferably the pin region has an at least partially conically tapering region at its end facing the other pipe section.

As already mentioned initially, the proposed design is particularly of great advantage when the pole tip is configured asymmetrically, preferably by fastening a damping buffer which is asymmetric relative to the pole axis or alternatively an asymmetric terminating plate (see in particular Nordic sports applications) in a manner secured against rotation to the pole tip and/or by configuring the pole handle to be asymmetric relative to the pole axis.

The pole handle can generally preferably comprise an asymmetric pole handle which, for example, has a hook-like device for fastening a hand holding device, in particular in the form of a hand loop or a glove, where in the region of the hook-like device displaceable or twistable engaging means are disposed in such a manner that a substantially loop-, ring- or eye-shaped device slid into the hook-like device from above, which is provided on the hand holding device, is fixed in a self-engaging manner in the hook-like device, where preferably the hook-like device is disposed on the pole handle on the hand side in the upper region, and where further preferably the hook-like device comprises a retaining mandrel or retaining pin disposed substantially parallel to the pole axis, which is offset from the handle body to form an insertion slot to the hand side or is disposed as an incision in the handle body, where the depth of the insertion slot is preferably greater than the width and the thickness of the retaining mandrel or retaining pin. Specifically in other words this can particularly preferably comprise a pole handle as disclosed in WO 2006/066423. With regard to the pole handle, the disclosure of this document is expressly included in the disclosure content of this document.

According to a further preferred embodiment, the pole handle is configured ergonomically, for example, as disclosed in EP 2 168 641. According to a particularly advantageous embodiment the pole handle has a cover on its handle head which can be removed. The handle head preferably has an axial through opening at its lower end, through which the upper end of the tension cable projects into the handle head. The upper cable connection can, for example, be configured by knotting the upper end of the tension cable. By removing the cover, the user can access the upper end of the tension cable and pull the tension cable from the pole without the pole handle needing to be dismantled.

According to a further preferred embodiment, the asymmetric pole tip comprises a tip body and a buffer, where the tip body and/or the lowermost section of the pole body are disposed to pass through a central opening of the buffer and where the buffer is displaceably mounted in an axial direction to the pole body in this central opening such that it can be fixed and where the buffer can be fixed in at least two axially different positions by means of a positive connection in relation to the pole body, where preferably the tip body has a latching link in which latching link a latching body mounted in the buffer can engage positively for fixing the axial position and the latching body is mounted pivotably and/or displaceably and/or fixedly in or on the buffer and where particularly preferably the latching body is configured in the form of a latching lever which is hinged on the outer side, where the latching lever is hinged on the outer sleeve with its lower end facing the asymmetric rolling surface of the buffer and with its upper end in the fixed position of the buffer at least partially positively embraces the pole pipe and/or an inner sleeve and can be pivoted away from an outer sleeve for releasing. Specifically in other words this can comprise a pole tip designed specifically for Nordic walking application, for example, one such as is described in WO 2008/037098. With regard to the configuration of the pole tip, the disclosure of this document is expressly included in the disclosure content of this application.

A further preferred embodiment of such a folding pole is characterised in that in the case of an external clamping mechanism, the external clamping device comprises a plastic sleeve which substantially directly embraces the pipe section at least in an axial section and clamps in the closed state, where the plastic sleeve at least in the region gripping the pipe section has at least one slot making the circumference of the plastic sleeve variable in this region and is configured to be substantially circumferential in the remaining axial region, where respectively one projection is disposed on the plastic sleeve on both sides of this slot, where these projections have a coaxial through opening disposed substantially perpendicular to the axis of the pipe section, through which a transverse pin grips, which pin has a stop on the outer side of the second projection and which, on the outer side of the first projection, has an axis of rotation for a clamping lever disposed perpendicular to the axis of the transverse pin and parallel to the axis of the pipe section, where the clamping lever has a lever arm which, when the clamping device is closed, embraces the plastic sleeve at least partially and where the clamping lever has an eccentric rolling region about the axis of rotation by which means the distance between the stop and a mating surface for clamping disposed on the outer side of the first projection can be reduced by pivoting the clamping lever into the closed position, where preferably the mating surface is configured in the form of a metal element disposed at least partially in the first projection in a recess and wherein further preferably the mating surface is configured as a flat surface or as a concave surface whose radius of curvature is substantially adapted to the radius of curvature of the rolling region and where further preferably the plastic sleeve has in its upper section at least two, preferably at least three axially running slots, where at least one of these slots is disposed between the two projections and preferably these slots are distributed uniformly around the circumference and/or wherein further preferably the said stop is configured to be adjustable, where preferably the stop is configured with a thread and the transverse pin is configured with a counterthread and the stop is configured as a nut or screw, preferably with a circumferential toothed structure and/or a comb and/or a groove for engagement of an adjusting tool. In other words, this can preferably comprise a clamping mechanism such as is disposed, for example, in WO 2010/085905. The disclosure of this document with respect to the clamping mechanism is expressly included in the disclosure content of this application.

If the folding pole has a positive snap-in locking device for the cable tension instead of an external clamping mechanism, the pole can be configured to be completely length-adjustable. The length adjusting mechanism can be an external clamping mechanism acting by means of force fit as described in the preceding section. Preferably the clamping mechanism is used for the telescopic length adjustment of the second pipe section and to this end is fastened on the first pipe section. Preferably the lower middle pipe section is configured to be adjustable in length. If the folding pole is configured to be adjustable in length, it preferably has an additional pipe section, preferably at the top adjoining the first pipe section to which the pole handle is fastened, where the external clamping mechanism is fastened to the uppermost pipe section.

The pole pipe is preferably substantially made of aluminium or carbon where in the case of a carbon design, the transitions zones of the individual pipe sections are reinforced by means of stabilising sleeves, for example, made of aluminium.

Further embodiments are given in the dependent claims.

BRIEF DESCRIPTION OF THE DRAWINGS

Preferred embodiments of the invention are described hereinafter with reference to the drawings, which merely serve for explanation and are not to be interpreted as restrictive. In the drawings.

DESCRIPTION OF PREFERRED EMBODIMENTS

Figure 1:
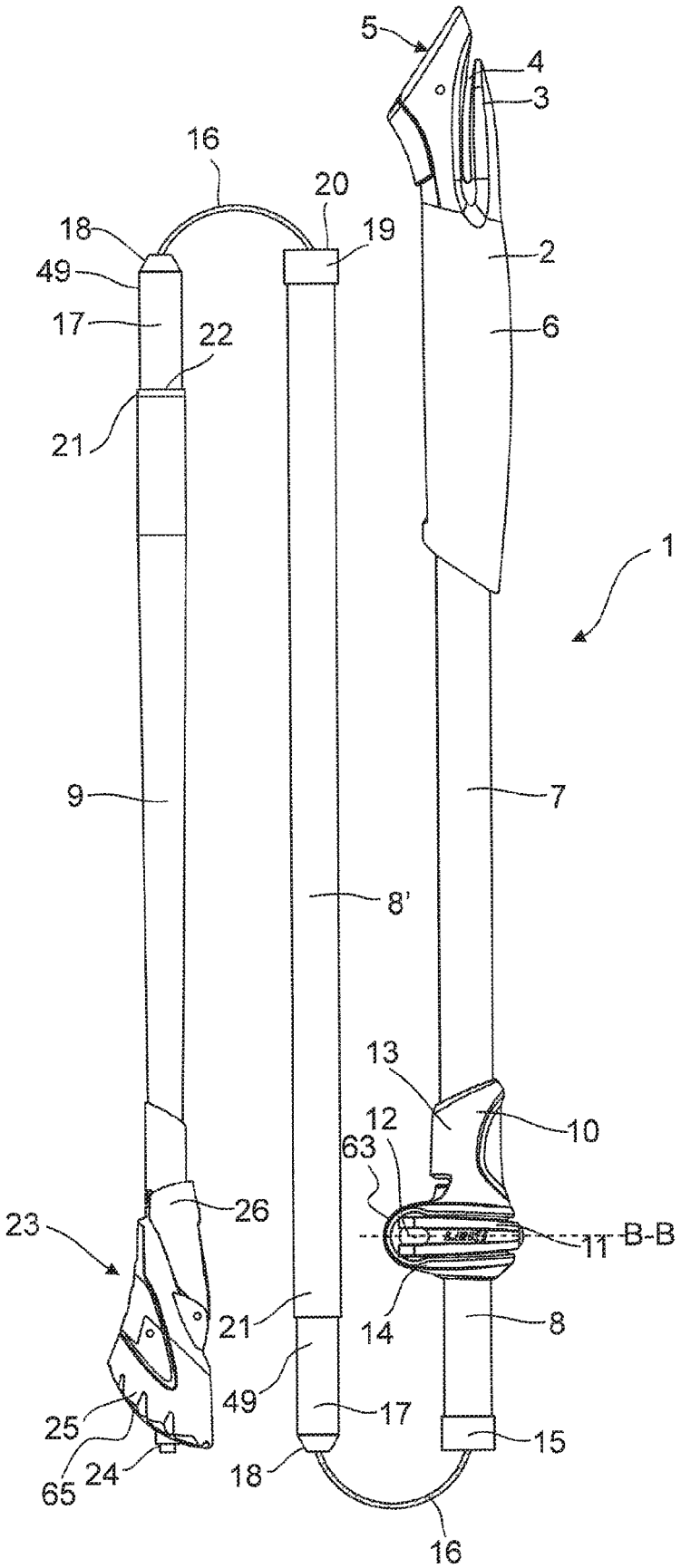
FIG. 1 shows a view of a pole with four pipe sections in the folded state where the lower two pipe sections are arranged loosely and only connected via the tension cable and the two upper pipe sections are pushed into one another as far as possible and fixed relative to one another in their axial position by means of the external clamping mechanism.
Figure 2:
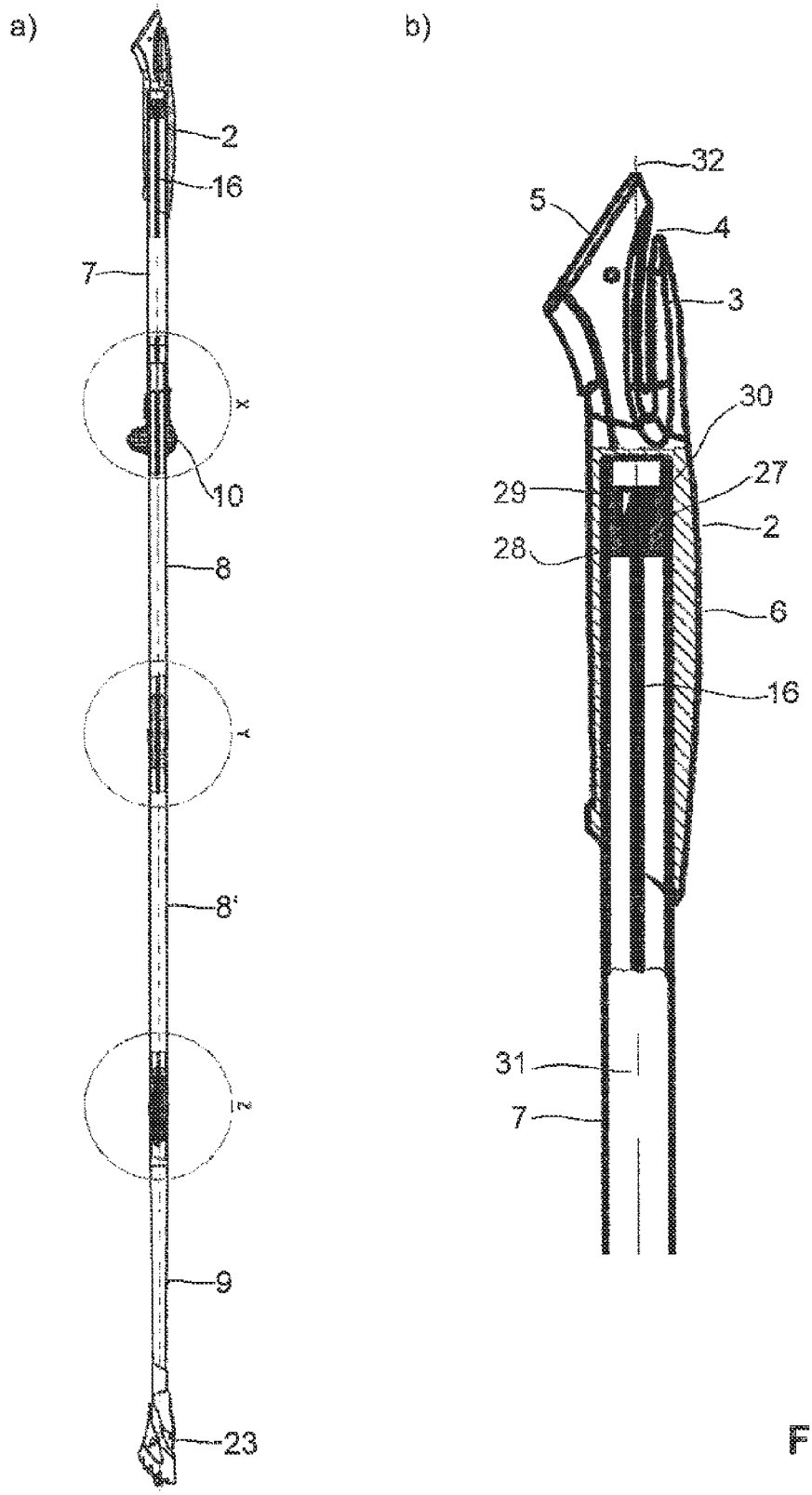
FIG. 2 shows in a) an axial section through a folding pole according to FIG. 1 in the assembled state, in b) the region of the pole handle, where the section in the pole handle is only executed in the central region as a section, a side view being shown in the lower region of the diagram and in the uppermost region of the diagram, in c)-e) the views according to X, Y or Z as shown in FIG. 2*a*); in f) a view of section B-B of FIG. 1; in g) a detailed view of the grip of FIG. 1.
Figure 2:
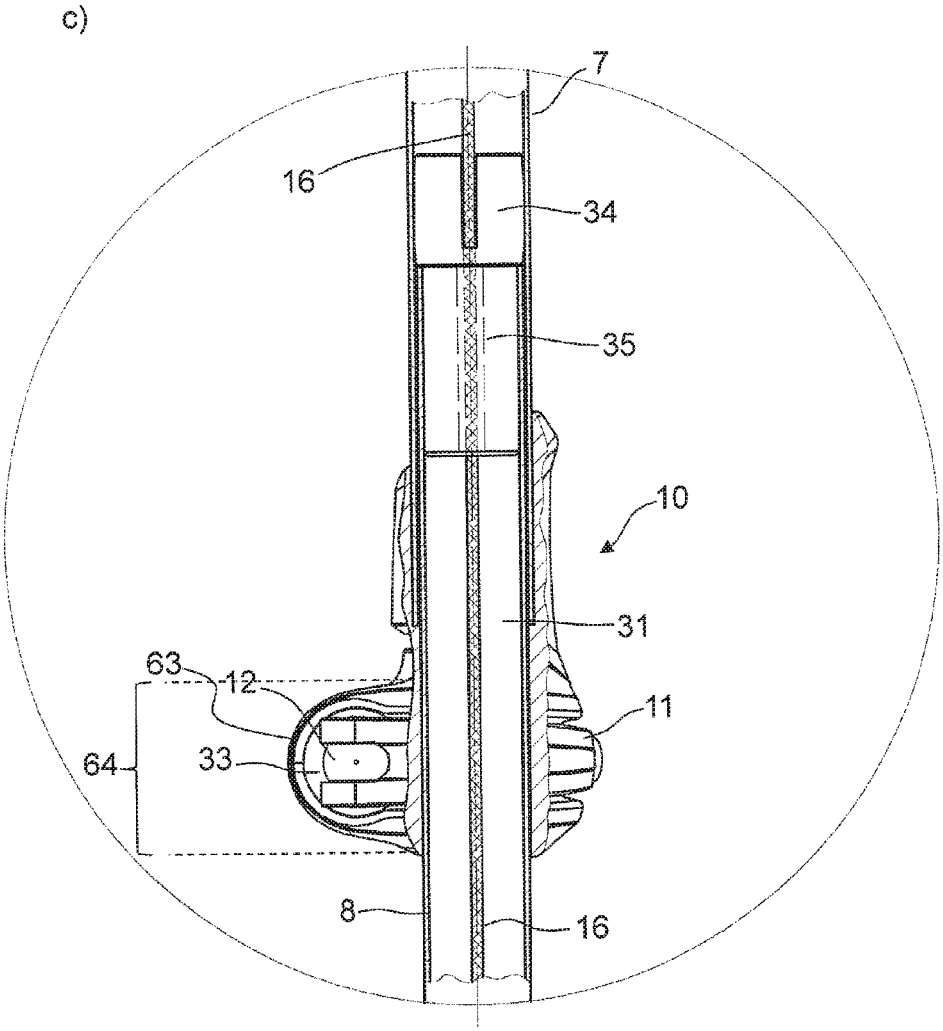
Figure 2:
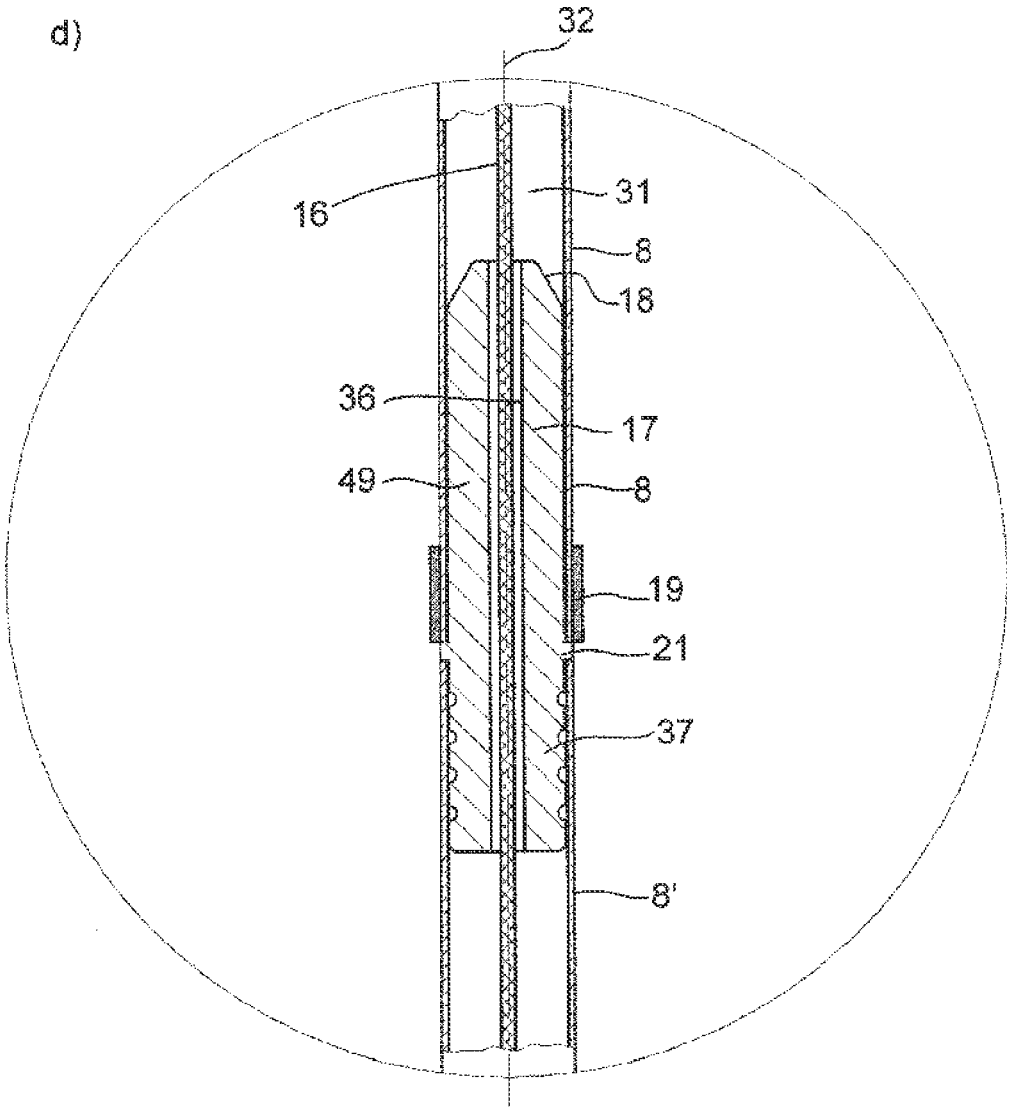
Figure 2:
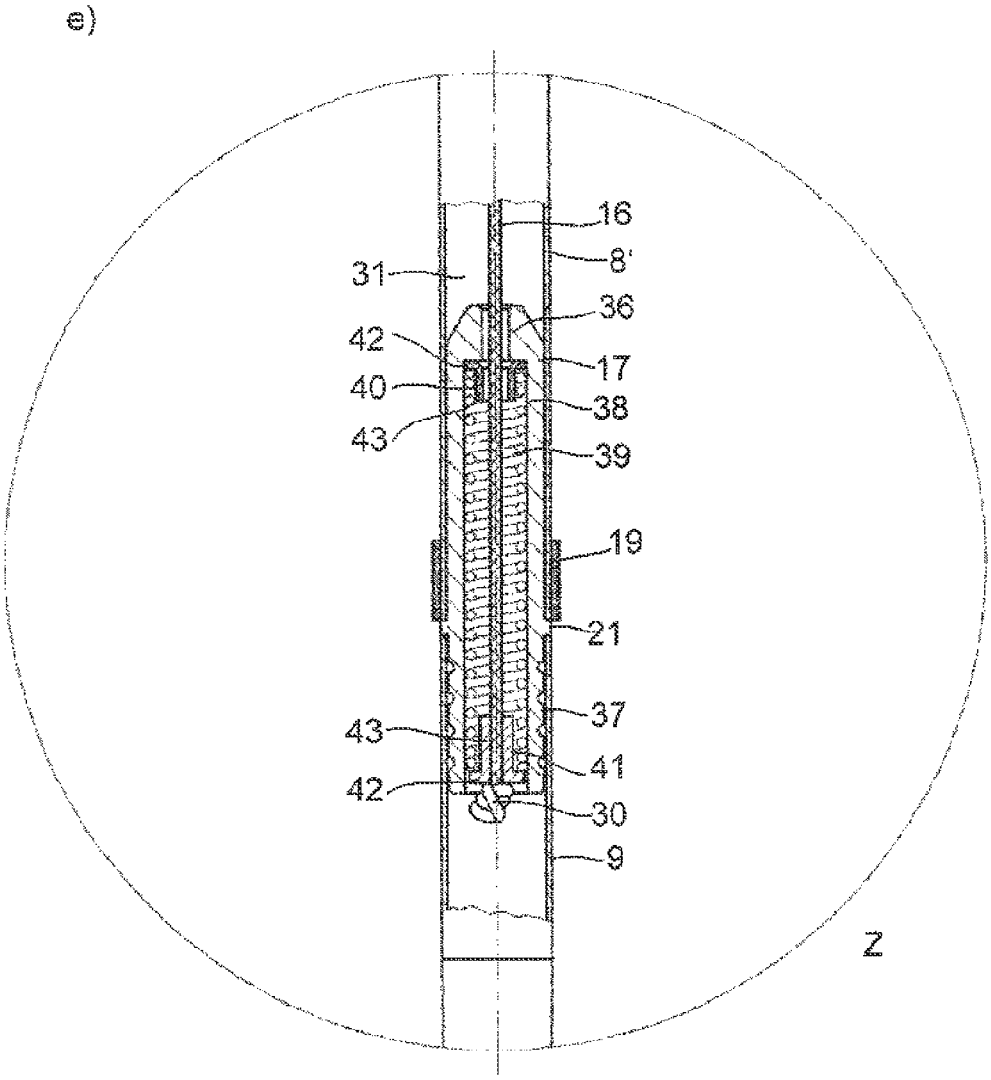
Figure 2G:
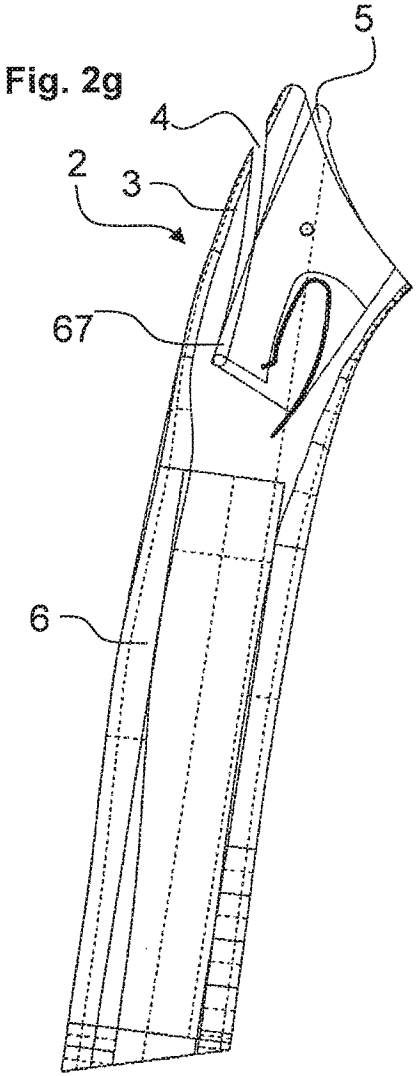
Figure 2F:
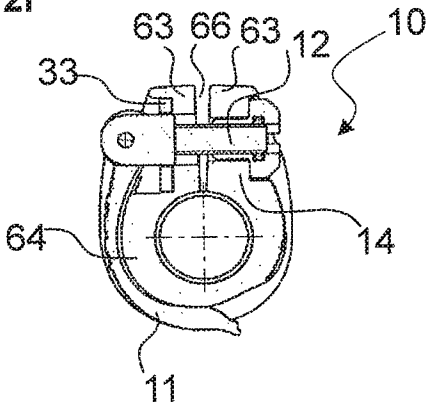

An exemplary embodiment of a folding pole 1 having four pipe sections 7-9 is shown in FIGS. 1 and 2. FIG. 1 shows such a folding pole 1 in the folded state, i.e. in that state where the uppermost two pipe sections are pushed completely into one another and the lower two pipe sections are arranged folded adjacent thereto and FIG. 2 shows the pole in the assembled state.

Specifically such a pole comprises an uppermost pipe section 7 on which a pole handle 2 is fastened right at the top. This pole handle 2 is configured asymmetrically in this case, in the running direction towards the front it is configured to be sloping right at the top and there has a trigger head 5 for a retaining mechanism for a hand holding device and to a certain extent towards the back over a retaining lug 3 which is configured in the form of a pin with a slot 4 disposed in front thereof. In other words, this comprises a pole handle as is known, for example, from WO 2006/066423 and as can be used, for example, together with a glove or a hand loop, as is known from WO 2006/066424, i.e. having a hand holding device which has a loop between thumb and index finger, which is guided over the retaining lug 3 and then can be locked in the slot 4 in a self-engaging manner. The pole handle furthermore has a handle region 6 which is usually configured as a region having a grip-friendly coating.

At the lower end of this uppermost pipe section, the pipe can fundamentally comprise a pipe made of aluminium or carbon composite material, this applies to all the pipe sections, an external clamping mechanism 10 is provided. In this specific case, this comprises an external clamping mechanism as is known from WO 2010/085905 but it could also comprise a clamping mechanism according to EP 098 898 or according to EP 1 217 224.

In this specific case, the clamping mechanism 10 in its upper region is fastened by means of a circumferential retaining region 13, which typically consists of plastic, on the pipe section 7, the upper pipe section 7 has an axially running slot 66 in the embraced region, in particular below the retaining region 13 so that the actual clamping region 64 of the sleeve disposed below the region 13 has the result that the outer pipe 7 can be clamped tightly to the inner pipe 8 inserted therein and thus a positive connection can be made between the two.

Below the circumferential retaining region 13 there is accordingly a slotted clamping region 14, where the slot 66 runs between two projections 63 through which passes a transversely running pin forming a clamping axis 12. The pin is fixed on the rear side, for example, with a nut and on the side shown here on the front side, said pin is connected to this by means of a transverse axis which forms a pivot point for the lever 11. At its fulcrum the lever 11 has two fork-shaped extensions which are configured as eccentrics so that in the clamped state of the clamping lever 11 as shown here when the lever 11 is placed around the pole pipe or around the clamping device, the slot is so severely tapered that clamping takes place and that when the lever 11 is folded outwards, this clamping is reduced because the eccentric expands the two projections 63 to a certain extent and releases the clamping.

In the uppermost pipe section 7 the upper of the two middle pipe sections 8 is pushed in from inside. The outside diameter of this upper middle pipe section 8 thus specifically corresponds to just somewhat smaller than the inside diameter of the uppermost pipe section so that displaceability is ensured but with the smallest possible play. The uppermost pipe section 7 thereby receives the upper of the middle pipe sections 8 as far as possible into itself in order to keep the pack size as small as possible. Typically the pipe section 8 is pushed in until it impacts against an upper fastening pin 27, the latter is explained in detail further below in connection with FIG. 2*b*.

The upper of the two middle pipe sections 8 is followed by another lower middle pipe section 8', folded down here to a certain extent, which has the same pipe diameter as the upper middle pipe section 8. A plug-in connection 17, which is not connected here is provided therebetween, the plug-in connection 17 having a guide pin 49 which is configured to taper conically 18 at its tip. The guide pin 49 is fastened at the lower of the two pipe sections 8' and is inserted therein via a fastening region 37, the other pipe section 8 typically has an upper pipe terminating sleeve 15 inter alia for protecting the pipe end but also for rotational fixing (cf. further below).

At the opposite end of the lower of the two middle pipe sections 8' a lower pipe terminating sleeve 19 is provided there for its part. Thus is followed by the lowermost pipe section 9, again folded, which in this case comprises a double-butted pipe which in the uppermost section has the same diameter as the two middle pipe sections 8, 8' but which tapers towards the bottom.

A pole tip 23 is fastened at the lower end of this lowermost pipe section 9, this pole tip is configured asymmetrically, i.e. in the lowermost region it has a beveled rubber buffer 25 which tapers to a point towards the back, which is here also configured to be adjustable insofar as adjustment can be made between at least two positions. Specifically this is between the position shown here where a hard tip 24 is disposed to pass through a hole in the rubber buffer 25, which is suitable for icy surfaces or gravelly soil but, if an adjusting lever 26 is tilted to the right, the buffer can also be displaced downwards and fixed there by renewed folding of the adjusting lever 26 so that in this position the tip 24 to a certain extent disappears in the opening in the buffer 25 and therefore only the rolling surface 65 of the asymmetric buffer comes in contact with the ground. The latter operating position is particularly advantageous in particular for tar surfaces or similar because the tedious clicking noises and the unpleasantly hard impact of the impingement of the tip no longer occur. In other words, this comprises a tip as is known for example from WO 2008/037098 and from the International Application WO 2011/128231, which claims the priority of the Swiss application dated 14 Apr. 2010 having the file reference CH 00533/10.

At the upper end the lowermost pipe section 9 also has a substantially identically configured plug-in connection 17 as in the case already described, i.e. there is a guide pin 49 which is configured to be conically tapering 18 at its tip and which has an outside diameter so that it can be inserted into the lower end of the lower middle pipe section 8'.

The individual pipe sections are monofilament and/or braided and/or ensheathed by means of a flexible but stretch-resistant tension cable 16 which, for example, is constructed of stretch-resistant plastic fibres such as, for example, Dyneema, Keylar or similar. A possibly ensheathed wire cable can just as possibly exist, having a thickness of 0.5-6 mm, preferably 1-3 mm, particularly preferably 1-2 mm. In order to ensure the tearing strength of the tension cable, for example, multifilaments comprising a plurality of parallel-disposed monofilaments, e.g. preferably made of Dyneema, are optionally potted in a carrier material or multifilaments comprising a plurality of braided monofilaments, e.g. made of Dyneema are possibly potted individually and/or as braiding into a carrier material. Chain-like tension cables are also possible. The individual pipe sections 8' and 9 are therefore connected loosely to the two upper pipe sections 7, 8 pushed into one another in this position, which is advantageous for transport and prevents the individual parts from getting lost. In sections, in particular in the sections provided for folding, the tension cable 16 can be provided with a protective sheathing, preferably in the form of a piece of hose or a directly sprayed-on protective sleeve, for example, consisting of plastic.

In order to make a spring mounting of the tension cable superfluous, an elastically stretchable tension cable can also be used, this can then be formed, for example, from monofilament polyamide cord, e.g. made of nylon and rubber cords or multicore, braided sheathed rubber cords are also feasible.

FIG. 2*a* shows an axial section through this pole when it is in the assembled state, i.e. when the two lower pipe sections 8' and 9 are plugged into one another and the two upper pipe sections 7, 8 are pulled apart as far as possible. The pole can be transferred from the folded position as shown in FIG. 1 into the position one inside the other according to FIG. 2*a* by inserting the lowermost pole pipe section 9 via the plug-in connection 17 into the lower of the two middle pipe sections 8', by then (or previously) inserting the middle section 8' into the other middle section 8 via the corresponding plug-in connection 17 and by then releasing the external clamping mechanism 10 by a loosening of the lever 11 and the pulling out the pipe 8 from the pipe 7. This is as far as that state where the tension cable 16, as shown in FIG. 2*a*, is under tension, the tension cable 16 is then fastened inside in the lowermost pipe section 9 and in the uppermost pipe section 7. The pole is now fixed in this position by again fixing the external clamping mechanism 10. The plug-in connections fixed to themselves only in one axial direction between the pipe sections 8, 8' or 8' and 9 are therefore also fixed in the other axial direction and are fully stable.

The situation will be further illustrated by reference to FIG. 2*b*, here it can be identified how the tension cable is held inside the pole handle 2 by means of an upper fastening pin 27 which is fastened inside in the uppermost pipe section 7. For this purpose the upper fastening pin has a through opening 28 which expands upwards into an expanded region 29. The tension cable 16 runs from below through the central through opening 28 and a fastening knot 30 is disposed in the expanded region 29. Accordingly the knot (can also be formed by a pearl, a screw nipple, a pinch sleeve or a moulded-on or welded-on head or another type of thickening) therefore sits firmly in the shoulder between the region 29 and 28 and thereby fixes the tension cable 16. The tension cable 16 ideally runs in the clamped state substantially on the pole axis 32.

The clamping region is shown in FIG. 2*c* in the position of the external clamping fixing. Here it can be identified that the upper middle pipe section 8 preferably has a terminating pin 34, also for protection of the uppermost end of the pipe, particularly in the case of carbon pipes, which pin must however have a central through opening 35 so that the tension cable 16 can run through this substantially without resistance. The tension cable 16 runs in the inner space 31 substantially unhindered through this adjusting region.

Figure 5:
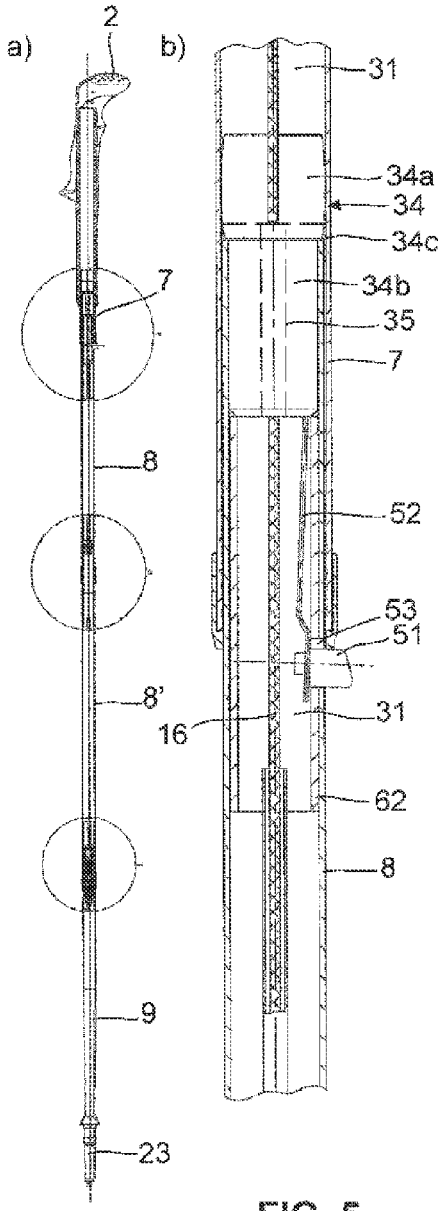
FIG. 5 shows in a) an axial section through a folding pole according to FIG. 4 in the assembled state, in b) a section through the region of the latching mechanism used for the cable tension between the first and the second pipe section according to V; in c) the view according to U as shown in FIG. 5*a*); in d) the view according to T as shown in FIG. 5*a*)
Figure 5:
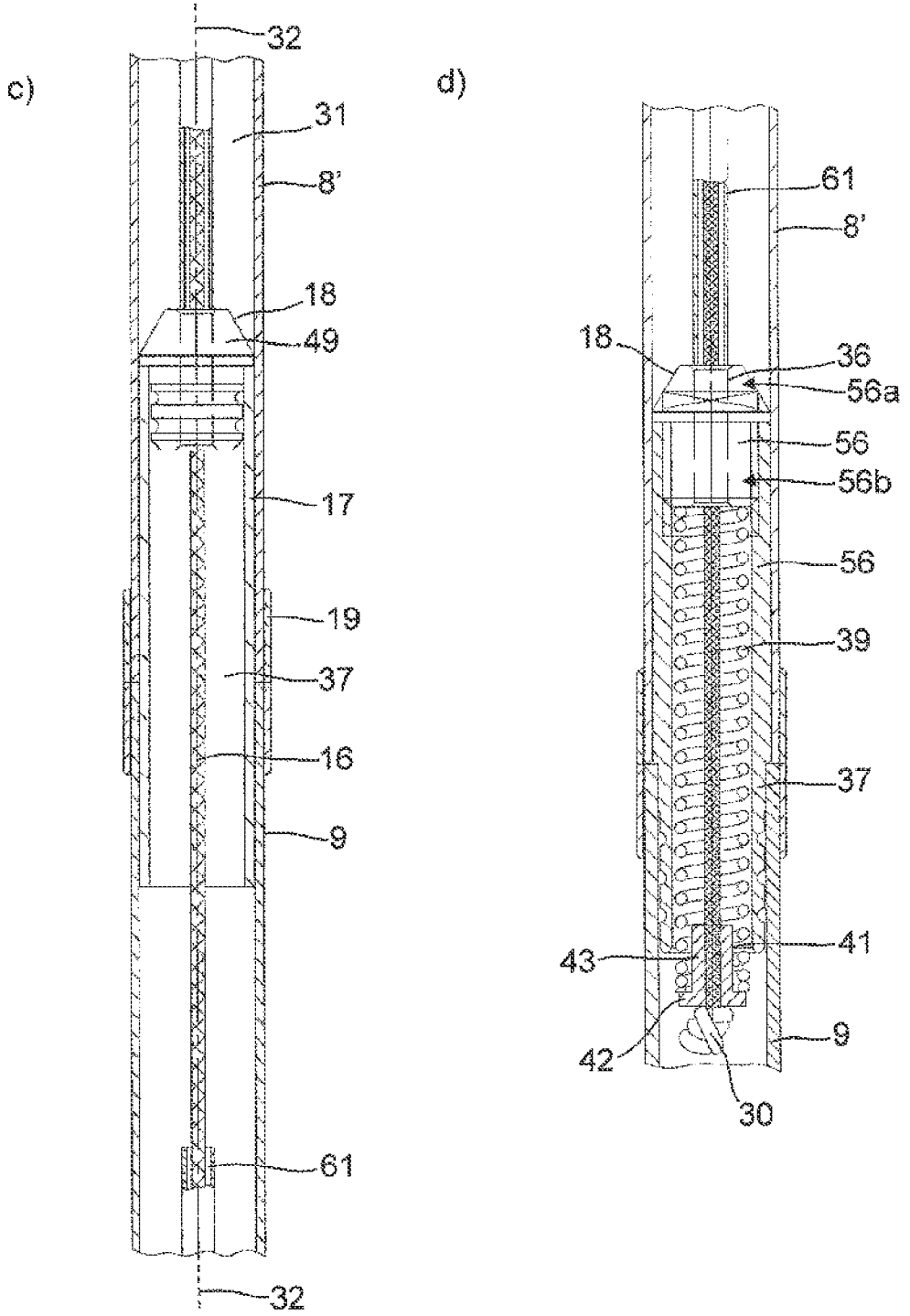
Figure 6:
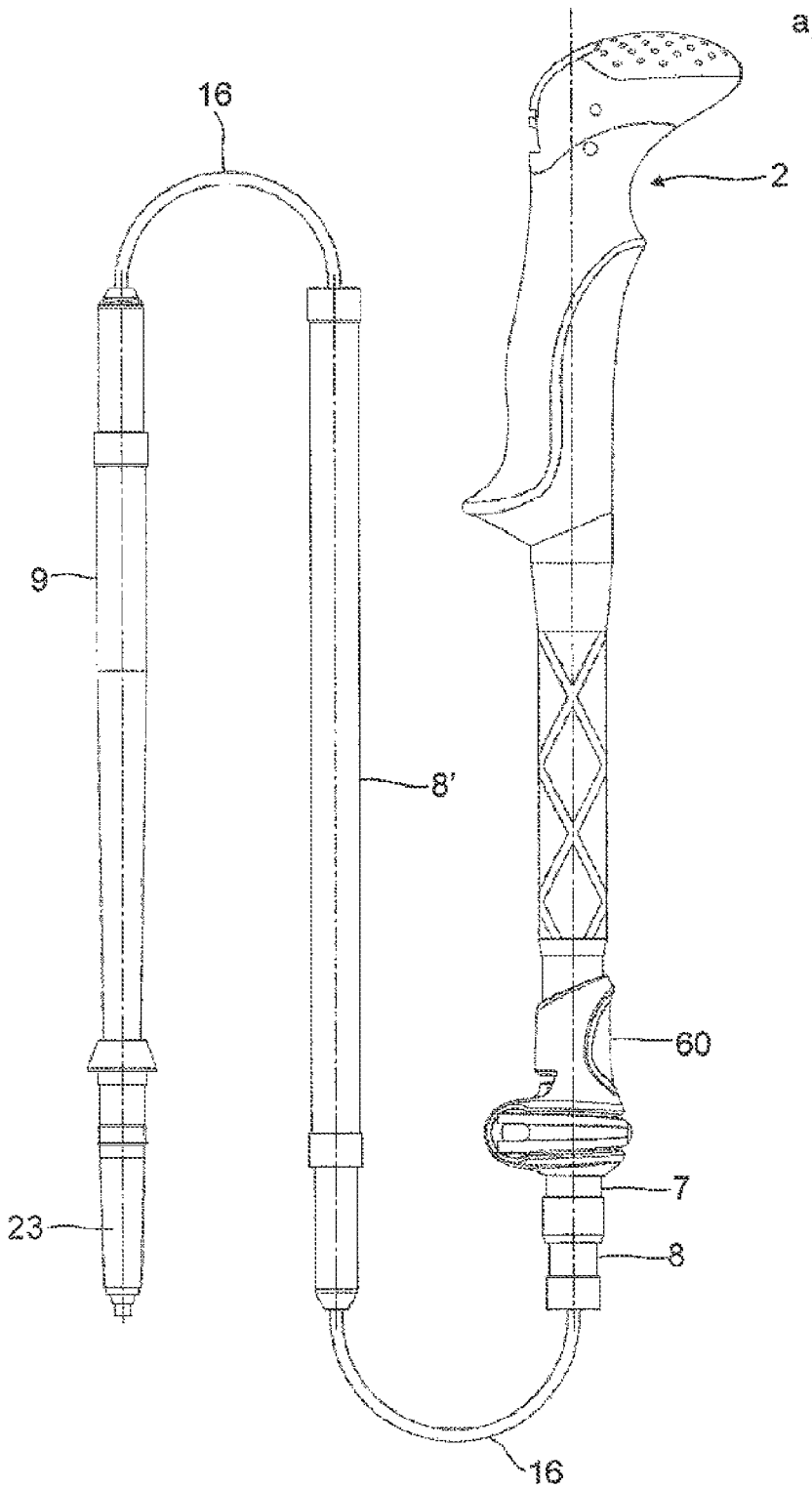
FIG. 6 shows a view of a pole according to a third preferred embodiment in the folded state, where the pole has a positive snap-in locking device for the cable tension and an external clamping mechanism for the length adjustment.
Figure 7:
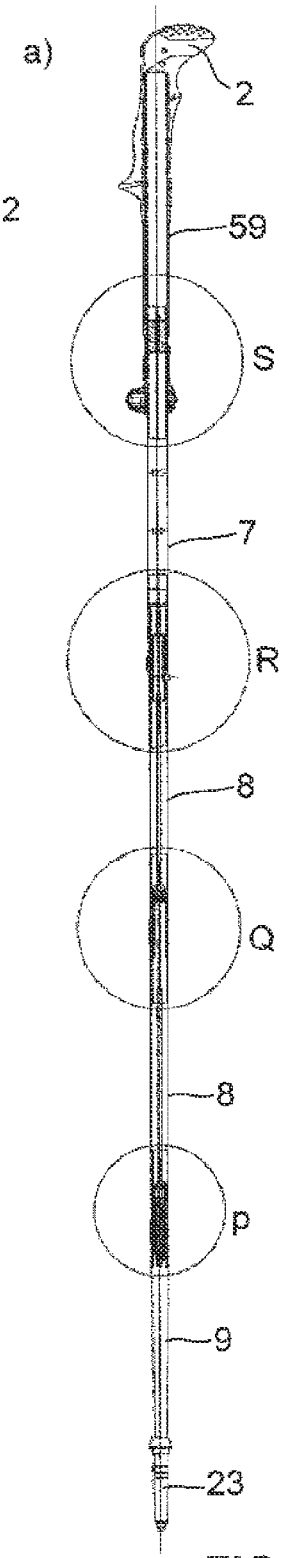
FIG. 7 shows in a) an axial section through a folding pole according to FIG. 6 in the assembled state, in b) a section through the region of the region of the external clamping mechanism used for the length adjustment and the region of the upper cable connection; in c) the view according to R as shown in FIG. 7*a*); in d) the view according to Q as shown in FIG. 7*a*); in e) the view according to P as shown in FIG. 7*a*)
Figure 7:
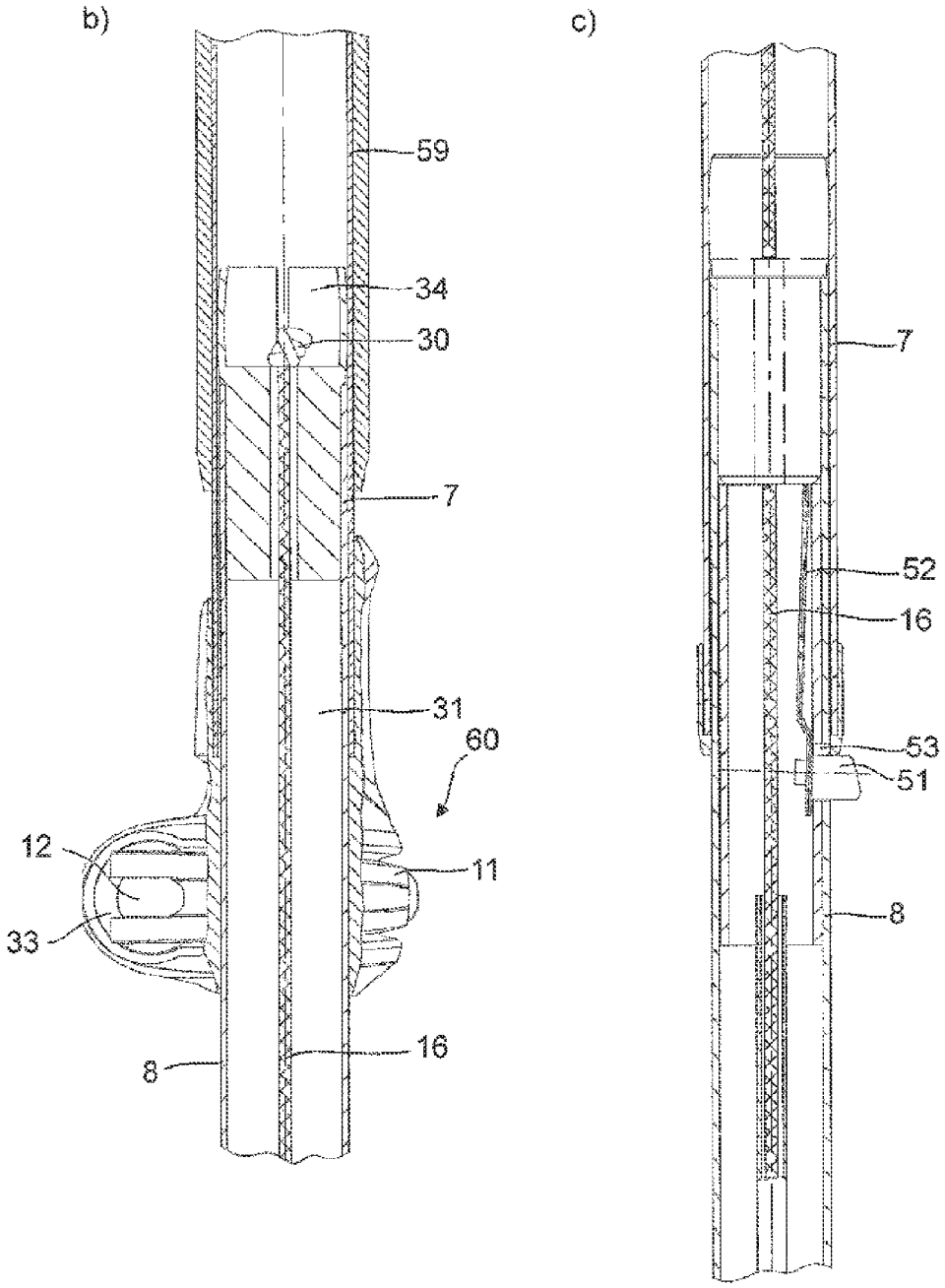
Figure 7:
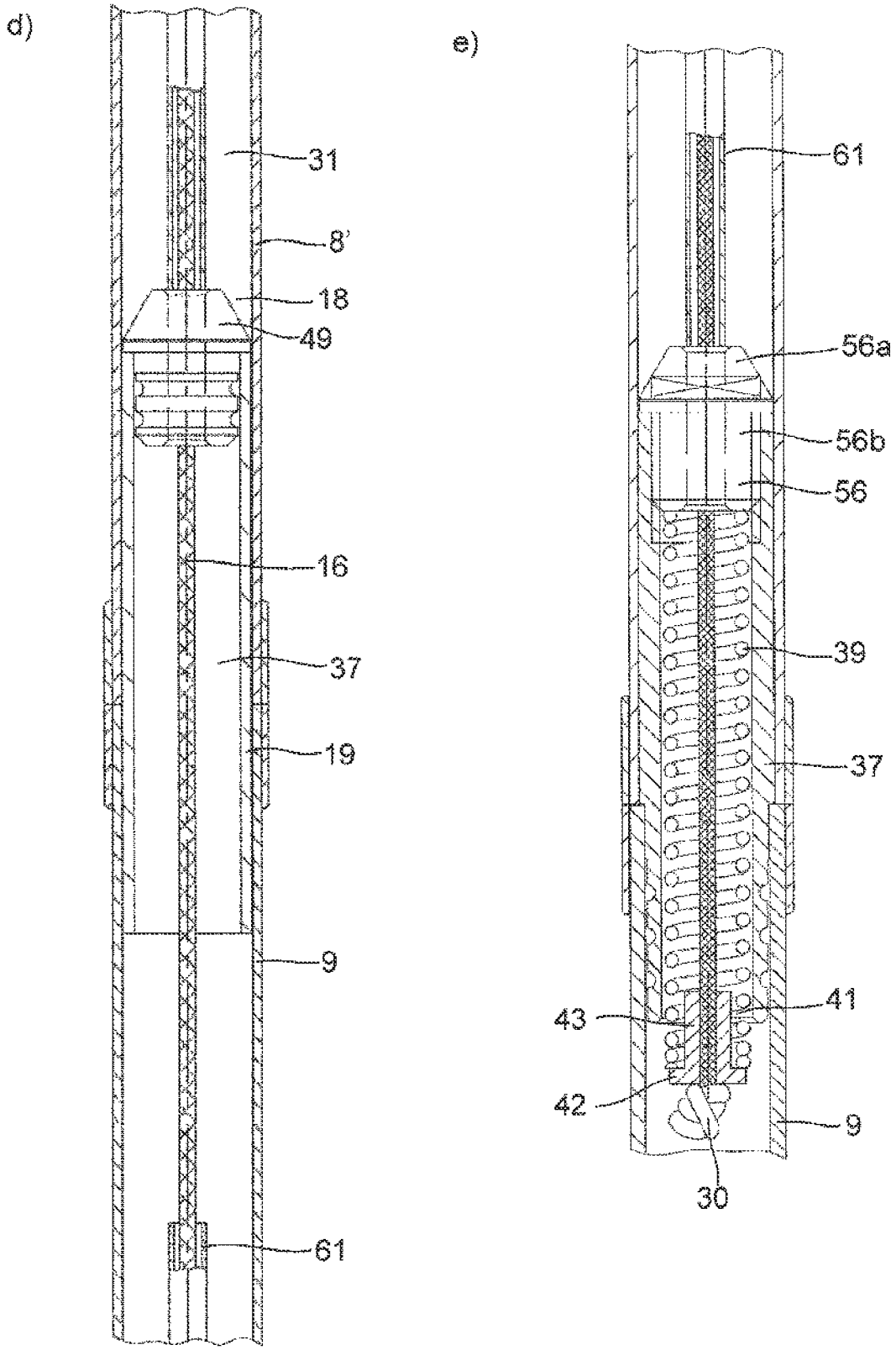

FIGS. 5*b* and 7*c* show alternative exemplary embodiments in which the cable tension is achieved by a positive latching mechanism instead of by an external clamping mechanism 10. The clamping mechanism shown in FIG. 7*b* is similar to that shown in FIG. 2*c* but fulfils the function of the length adjustment of the upper part of the second pipe section 8'. The upper connection of the tension cable is shown here. The tension cable is knotted at its upper end and the knot prevents the tension cable from passing through the through opening 35 of the terminating pin 34.

Figure 8:
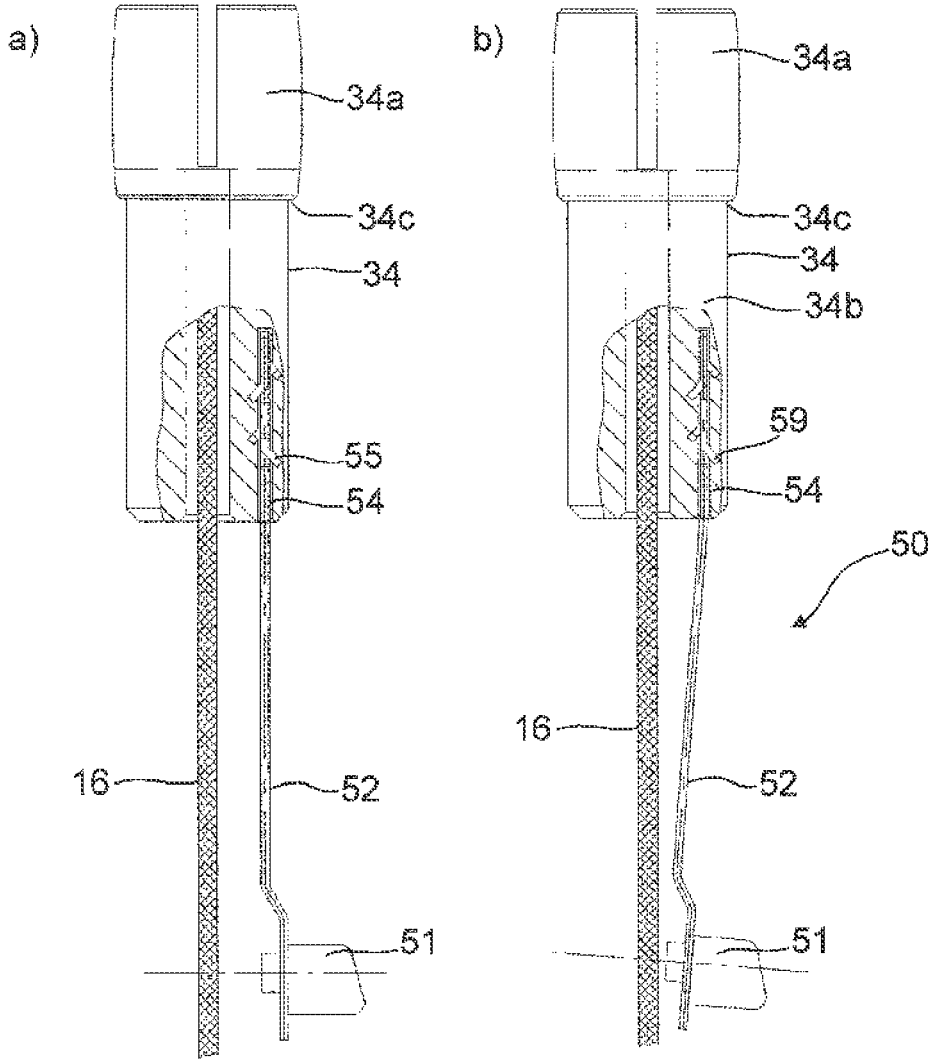
FIG. 8 shows in a) and b) respectively one partial axial section through a terminating pin according to FIGS. 5*b* and 7*c*, where in a) the snap-in locking device is shown in the non-actuated state and in b) in the actuated state.

The terminating pin 34 additionally, as shown in FIG. 8, has a channel 54 into which the upper end of a leaf spring 52 projects and in which the leaf spring 52 is fastened in a self-restraining manner, here with the aid of barbed hooks 55. A locking pin 51 is fastened, e.g. riveted to the lower end of the leaf spring 52. If pressure is applied to the locking pin to release the latching mechanism in the radial direction, the leaf spring is tensioned and the locking pin 51 enters at least partially through the through opening 35 into the inner space 31 of the pole pipe.

In the two alternative exemplary embodiments of FIGS. 5*b* and 7*c* the second pipe section 8 has respectively one terminating pin 34 which has an axial through opening 35 for the tension cable. In the assembled pole the head 34*a* of the terminating pin 34 is inserted in the first pipe section 7 adjoining the second pipe section 8 at the top whilst the collar 34*c* rests on the upper end of the second pipe section 8 and projects with the neck section 34*b* into the upper end of the second pipe section 8. The neck section 34*b* finds a stop at the upper end of an insertion element 62 fixed in the second pipe section 8. The insertion element 62 rests with its outer wall on the inner wall of the second pipe section 8 and has a through opening 53 which is in alignment or coincides with that of the second pipe section 8 so that the locking pin 51 can project outwards through this through opening 53 from the inner space 31 of the pole pipe through said pipe outwards.

The poles according to the exemplary embodiments shown in FIGS. 4 and 5*a* or 6 and 7*a* have an ergonomically shaped pole handle 2, the handle head 57 whereof has a cover 58 which can be opened and removed. If this cover 58 is opened or removed, the knot 30 described above or the upper end of the tension cable 16 is accessible through the cavity in the handle head 58 which, in combination with the configuration of the lower cable connection described above, enables the tension cable to be exchanged in the event of wear.

FIG. 2*d* shows enlarged the region characterised by Y in FIG. 2*a*. Here it can now be identified how the plug-in connection 17 is specifically configured. The actual plug-in connecting element, which is typically made of plastic and in one piece, is fastened in the lower of the two middle pipe sections 8' by means of a fastening region or a fastening section 37, this is, for example, firmly glued and/or firmly clamped in the pipe and can have circumferential recesses for this purpose, as shown in this figure. Adjoining this fastening region 37 at the top is a circumferential flange 21 which on the one hand serves to limit the insertion depth of the fastening region 37 into the lower pole pipe 8' and on the other hand however defines the axial stop for the upper pipe section. The outside diameter of this circumferential flange 21 can either, as shown in this figure, substantially correspond to the outside diameter of the pipe sections but can also be larger and for example, correspond to the outside diameter of a lower pipe terminating sleeve 19 which is provided on the pipe section disposed at the top on the lower end thereof, and which ensures the rotational position secured against rotation, described in particular in connection with FIG. 3, in interaction with the section 21.

The actual pin region 49 can be identified above the circumferential flange 21. This pin region 49 is provided to be inserted into the lowermost region of the middle pipe section 8 disposed at the top and to ensure that the two pipe sections are arranged as stably as possible axially to the pole axis. The plug-in connection only ensures that the upper pipe section 8 can only be inserted into the lower pipe section 8' as far as the stop on the element 21. However, the plug-in connection does not ensure against pulling apart again, this securing is accomplished, as described above, by the tensioned tension cable 16. A central axial through opening 36 runs through the entire plug-in connection 17, which opening must be sufficiently large for the tension cable 16 to pass through unhindered and free from friction by the plug-in connection 17.

As in the alternative exemplary embodiments according to FIGS. 5*c* and 7*d*, the plug-in connection 17 can also be configured to be two-part. The head region 49 which comprises a head section with conically tapering region 18 herewith projects with a neck section into the upper section of the fastening section. In this case, the pin region 49 can be made, for example, of plastic and the fastening section 37 can be made of aluminium. In the exemplary embodiments shown in FIGS. 5*c* and 7*d* the plug-in connection 17 has no circumferential flange 21 between pin region 49 and fastening section 37 so that the two pipe sections 8' and 9 rest against one another without being offset. The region where the two pipe section rest against one another is here encased by a pipe terminating sleeve 19. The pin region can alternatively be provided with means which enable the plug-in connection to be pushed into one another but largely minimise the play present between the two parts. Here for example, O rings inserted in circumferentially disposed annular grooves or other measures having the same effect are feasible.

The lower plug-in connection between the lowermost pipe section 9 and the lower of the two middle pipe sections 8' is shown in FIG. 2*e*. The same plug-in connection could also be provided here as described in connection with FIG. 2*d*), where the tension cable 36 could simply be fastened with a knot at the lower end of the through opening 36 but a spring-loaded mechanism could also be used here in which specifically a spring-elastic element, here a spiral spring 39 is let into an expansion region 38 of the plug-in connection 17. This spiral spring 39 lies with its upper end via a guide element 40, or a radial flange 42 thereof, on a shoulder of the plug-in connection 17 and the inside diameter of the spiral spring 39 is guided through an axial guide section 43 of the guide element 40. The tension cable 16 runs through the inner space of the spiral spring 39 and this is fastened to a lower guide element 41 or terminating element. For this purpose the terminating element 41 also has an axial guide section which at least partially engages in the spiral spring 39 or into its inner space as well as a radial flange 42 disposed below and preferably configured to be circumferential, which serves as a support on the one hand for the spiral spring 39 and on the other hand for the knot 30. This leads to an elastic mounting of the tension cable 16 and if, when fastening the pole in the assembled state, this spring 39 is somewhat compressed by a corresponding upwards pulling of the tension cable 16, it is thus ensured that the tension cable 16 always remains under a substantially uniform tension even if, for example, the uppermost two pipe sections 7, 8 are undesirably displaced to some extent relative to one another in the axial direction or if, for example, the tension cable 16 fluctuates in its length as a result of moisture fluctuations and/or temperature changes. This therefore leads to an improved retaining effect of the overall design.

Figure 3:
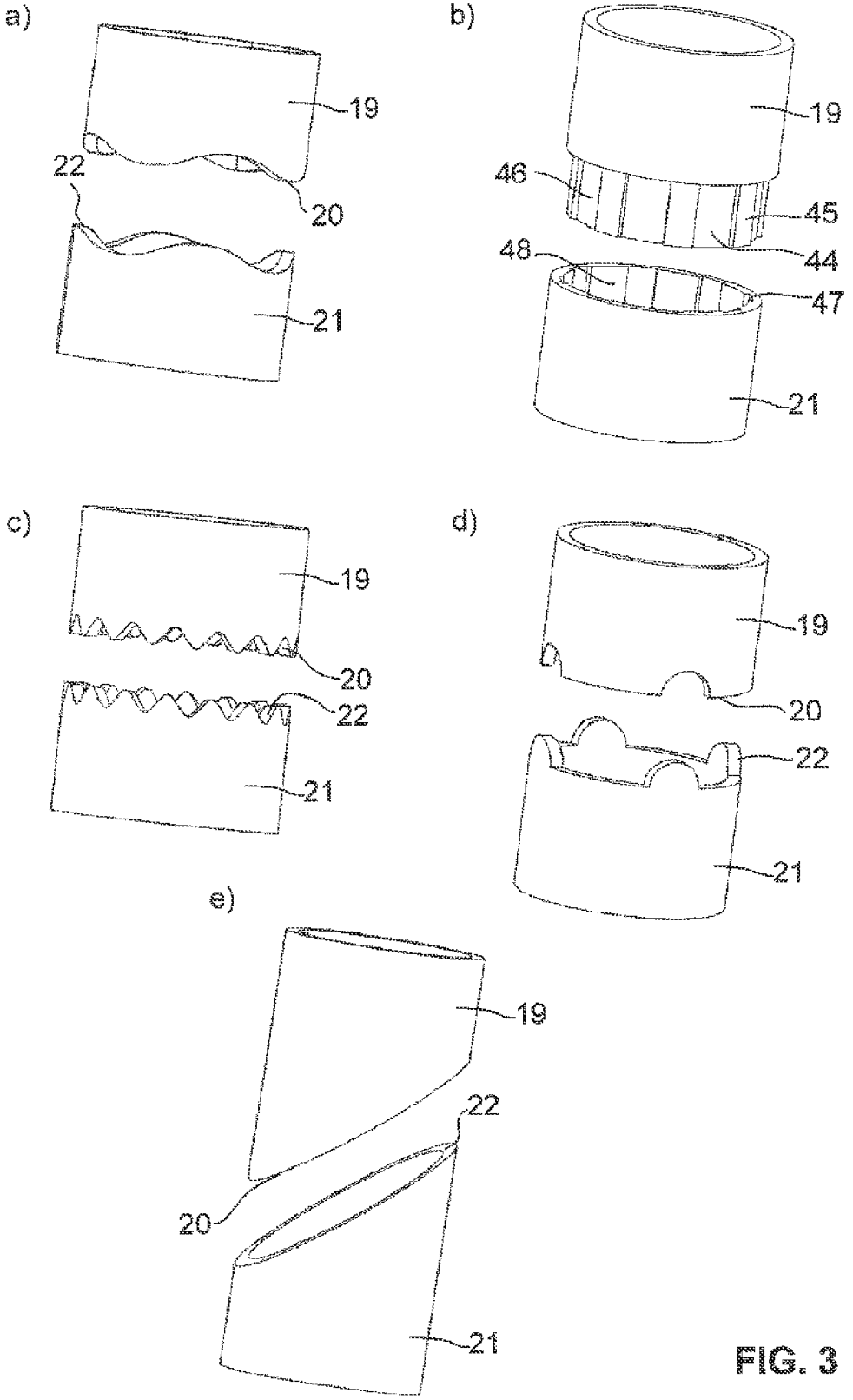
FIG. 3 shows different perspective views of possible anti-turn locking devices of the plug-in connection where in the embodiments according to a) and c)-e), the actual guide pin of the plug-in connection is omitted for better illustration and such a guide pin can also additionally be provided in the diagram b) albeit not necessarily.
Figure 4:
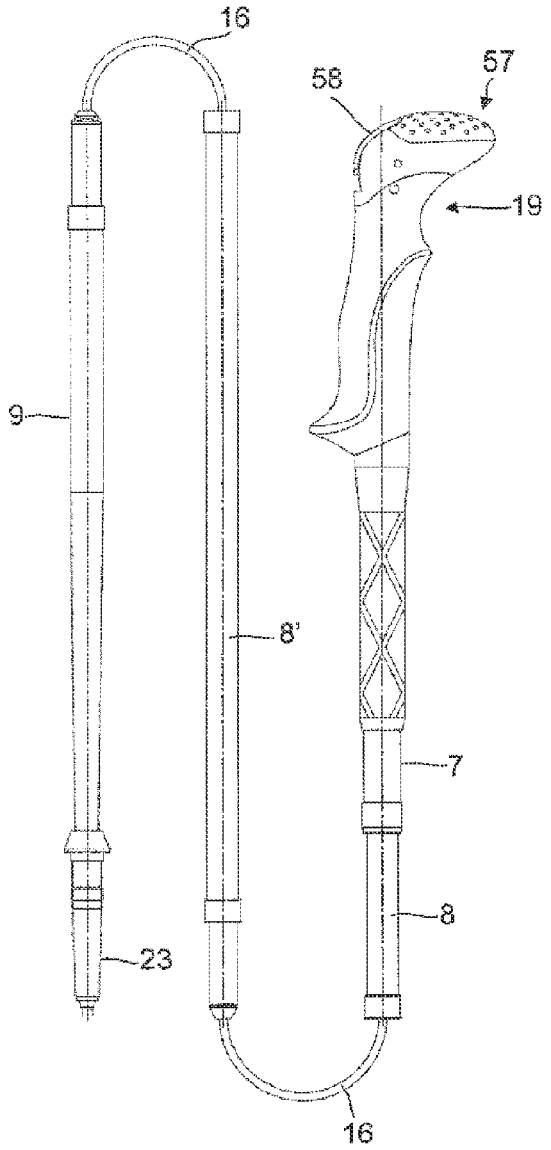
FIG. 4 shows a view of a pole according to a second preferred embodiment in the folded state, where the pole has a positive snap-in locking device for the cable tension instead of an external clamping mechanism.

In the exemplary embodiments shown in FIGS. 5*d* and 7*e* the plug-in connection 17 is formed in two parts from a retaining element 37 and a closure element 56. In this case the closure element 56, which has an outer threaded hole in the neck section 56*b*, is screwed into the upper end of the retaining element 37 which has an inner threaded hole. The closure element can here be configured similarly to the pin region 49 of the plug-in connection or the guide pin 17 between the pipe sections 8' and 9. Not shown in FIGS. 5*d* and 7*e* but advantageously disposed between closure element 56 and spiral spring is an upper stop element similar to the upper stop element 40 shown in FIG. 2*e*. Since the closure element 56 can be removed from the retaining element or the plug-in connection 17, the tension cable 16 can be replaced simply by opening the knot at the lower end and pulling the tension cable through all the axial through openings, replacing, looping through again and knotting. The retaining element 37 here has an upper region having an inner threaded hole, a middle region with a shoulder for resting on the upper end of the lower pipe section 9 and a lower region which serves for effective retaining of the plug-in connection in the upper end of the lower pipe section. As can be seen from FIG. 1, both the pole handle and also the pole tip are configured asymmetrically. In order that the pole can be used appropriately, these two elements should therefore be defined in their rotational position, specifically they should be disposed in their rotational position as shown in FIG. 2*a*. Ideal rolling of the rubber buffer 25 when walking on the ground only takes place in this way. This relative rotational position should therefore be ensured. If a simple plug-in connection is used, it cannot be excluded that the lower pipe sections twist relative to one another during use and therefore the correct relative rotational position between pole handle and pole tip can no longer be ensured. Accordingly the pipe terminating sleeves 15 or 19 and the corresponding stop surfaces on the plug-in connection 17 are preferably configured so that they are secured against twisting by means of a form fit. For this purpose, there are various possibilities which are shown in FIG. 3. For example, as shown in a), it is possible to configure the axial stop surface 20 on the lower pipe terminating sleeve 19 (similar to 15) as corrugated and configure the corresponding stop surface 22 on the element 21 of the plug-in connection 17 are correspondingly corrugated. If a design as in FIG. 3*a* is specifically selected, it can be ensured that no twisting of the pipe sections relative to one another takes place.

Such a fixing of the rotational position can be accomplished by means of the axial stop but can also be accomplished by means of the radial contact region of the plug-in connection, this being shown as an example in FIG. 3*b*, where an intermeshing region is equipped with ribs 45 and grooves 46 and the corresponding radial contact region on the element 21 by corresponding grooves 47 or ribs 48. Such a configuration of a radial contact region can either be configured, as shown here, by means of a specific engagement section 44 in addition to the guide pin 49 but it is also possible to configure the guide pin itself with such longitudinally running ribs and, for example, an inner region of the corresponding lower pipe terminating sleeve 19 with corresponding inner guide elements. By means of FIGS. 3*c-e*) it is illustrated that this positive fixing can be achieved differently, specifically by, for example, providing a corrugated toothed structure as shown in FIG. 3*c*), by providing individual or, as in FIG. 3*d*) a plurality of locking element or projections and recesses or by quite simply making the axial contact surfaces bevelled as shown in FIG. 3*e*). In principle, however it is also possible to provide the security against twisting, for example, by means of a transverse pin which engages in one or more grooves in the corresponding opposite section of the plug-in connection. Additional external guide pins which, for example, engage in openings of opposite parts of the plug-in connections are also feasible.

REFERENCE LIST

1 Folding pole
2 Pole handle
3 Retaining lug
4 Slot
5 Release head
6 Grip region of 2
7 First pipe section
8 Second pipe section
8' Further middle pipe section
9 Lower pipe section
10 External clamping mechanism
11 Clamping lever
12 Clamping axis

13 Circumferential retaining region of 10
14 slotted clamping region of 10
15 Upper pipe terminating sleeve
16 Tension cable
17 Guide pin or plug-in connection
18 Conically tapering region of 17
19 Lower pipe terminating sleeve
20 Contact surface of 19 on 21
21 Contact surface of lower holder of 17
22 Contact surface of 21 on 19
23 Pole tip
24 Tip element
25 Rubber buffer
26 Adjusting lever
27 Retaining element or upper fastening pin for 16
28 Central through opening in 27 for 16
29 Expanded region of 28 in upper section of 27
30 Knot in 16
31 Inner space in pipe
32 Pole axis
33 Washer
34 Terminating pin
34*a* Head region of 34
34*b* Neck region of 34
34*c* Collar of 34
35 Axial through opening for 16 in 34
36 Axial through opening for 16 in 17
37 Retaining element or fastening section
38 Expansion of 36 for 39
39 Spiral spring
40 Guide element or stop element for 39
41 Guide element or terminating element for 39
42 Radial flange of 40/41
43 Axial guide section of 40/41
44 Engagement section of 19
45 Radially external axial ribs on 44
46 Radially external axial grooves on 44
47 Radially internal axial grooves on inner side of 21
48 Radially internal axial ribs on inner side of 21
49 Pin region of 17
50 Snap-in locking device
51 Locking pin
52 Spring element
53 Radial through hole in 8 and 62
54 Axial channel in 34
55 Retaining means of 52
56 Closure element
56*a* Head section of 56
56*b* Neck section of 56
56*c* Axial through opening of 56
57 Handle head
58 Cover of 57
59 Additional pipe section
60 External clamping mechanism for length adjustment
61 Protective sheathing
62 Insertion element, plug-in element

The invention claimed is:

1. A folding pole, comprising at least four pipe sections, wherein the pipe sections are connected to each other by means of plug-in connections whilst aligned along the pole axis in the assembled state of the folding pole, and at least two pipe sections are still connected to each other by means of a movable connecting element, being at least one tension cable, in the folded state, and wherein a pole handle is arranged on an uppermost pipe section and a pole tip is arranged on a lowermost pipe section wherein at least one of the plug-in connections is achieved by means of a positive snap-in locking device on a second pipe section, wherein the second pipe section has an outside diameter smaller than or approximately equal to the inside diameter of a first pipe section and can be slid into the first pipe section and can be fixed in the relative axial position by the positive snap-in locking device, wherein the first pipe section is the uppermost or second uppermost pipe section and that the second pipe section is the first adjoining middle pipe section downwards, wherein the snap-in locking device comprises a spring-loaded radial locking pin which is held against the action of a spring element in the form of a leaf spring penetrating in a radial through hole of the second pipe section;

wherein the further plug-in connections are configured as pure plug-in connections, in which pipe sections are fastened only in an axial direction in the connected state, wherein the pipe sections are connected to each other by means of the at least one tension cable, which is fastened to the lowermost pipe section and to the uppermost pipe section and which is arranged so as to pass through the interior of the at least two middle pipe sections, wherein the second pipe section has a terminating pin disposed along the pole longitudinal axis, the terminating pin having a central through opening for the tension cable and further having a channel into which an upper end of the leaf spring projects and in which the leaf spring is fastened in a self-restraining manner;

and wherein the folding pole is configured in such a manner that the folding pole can be transferred from the folded state to the assembled state by connecting the further plug-in connections and then, with the snap-in locking device released, pulling the second pipe section out of the first pipe section until the tension cable is under tension, and fixing the positive snap-in locking device.

2. The folding pole according to claim 1, wherein at least one plug-in connection is achieved by means of an external clamping mechanism.

3. The folding pole according to claim 1, wherein the further plug-in connections are configured in such a manner that they are secured in an axial stop position against a relative twisting of the associated pipe sections about the pole axis.

4. The folding pole according to claim 3, wherein a positive connection is ensured whereby in the axial stop position, regions of the two connected pipe sections coming in contact are configured asymmetrically about the pole axis.

5. The folding pole according to claim 3, wherein a positive connection is achieved whereby axially directed stop faces are correspondingly toothed, corrugated, beveled and/or configured with a transverse pin engaging in one or more grooves.

6. The folding pole according to claim 3, wherein the further plug-in connections are configured in such a manner that on one pipe section they have a guide pin provided with an axially running central through opening for the tension cable, which is firmly fastened in this pipe section with a fastening section and axially opposite thereto has a pin region which can be slid into another pipe section, wherein between the fastening section and the pin region there is provided a outwardly directed contact flange which in the assembled state is brought into axial contact with a pipe end of the other pipe section and/or with a pipe closure sleeve provided thereon, wherein the contact flange providing an axial stop is configured asymmetrically about the pole axis and/or wherein further the pin region has an at least partially conically tapering region at its end facing the other pipe section.

7. The folding pole according to claim 3, wherein the further plug-in connections are configured in such a manner that they are secured in the axial stop position against a relative twisting of the associated pipe sections about the pole axis, by ensuring a positive connection, which furthermore locks automatically when the plug-in connections are pushed together.

8. The folding pole according to claim 7, wherein the positive connection is ensured whereby in the axial stop position, regions of the two connected pipe sections coming in contact are configured asymmetrically about the pole axis wherein the regions coming in contact comprise substantially axially directed stop faces and/or regions of the plug-in connection coming in contact in the radial direction.

9. The folding pole according to claim 1, wherein the pipe sections are dimensioned in such a manner that in the assembled state the uppermost middle pipe section can be substantially completely inserted into the uppermost pipe section.

10. The folding pole according to claim 1, wherein the tension cable is fastened to the lowermost pipe section and/or to the uppermost pipe section, by providing an axially fixed retaining element to which the tension cable is fastened.

11. The folding pole according to claim 10, wherein the retaining element comprises a closure element which can be fixed detachably in the upper end of the retaining element, having an axial through opening for the tension cable.

12. The folding pole according to claim 10, wherein the fastening of the tension cable on the retaining element is configured to be elastically spring-mounted.

13. The folding pole according to claim 10, wherein the retaining element comprises a closure element which can be fixed detachably, preferably by screwing in or plugging and locking against rotation by means of a bayonet closure, in an upper end of the retaining element, having an axial through opening for the tension cable.

14. The folding pole according to claim 10, wherein the fastening of the tension cable on the retaining element is configured to be elastically spring-mounted, by providing a spiral spring in the retaining element, through the interior of which the tension cable is disposed to run, wherein the tension cable is configured to be elastic or tension-resistant and inelastic at least in sections, preferably in the longitudinal direction.

15. The folding pole according to claim 14, wherein the tension cable is configured to be tension-resistant and inelastic over the entire length in the longitudinal direction.

16. The folding pole according to claim 1, wherein the pole tip is configured asymmetrically.

17. The folding pole according to claim 16, wherein the pole handle has a retaining lug for fastening a hand holding device, in the form of a hand loop or a glove, wherein in a region of the retaining lug displaceable or twistable engaging means are disposed in such a manner that a substantially loop-, ring- or eye-shaped device slid into the retaining lug from above, is fixed in a self-engaging manner in the retaining lug, wherein the retaining lug is disposed on the pole handle on the hand side in the upper region, and wherein the retaining lug comprises a retaining mandrel or retaining pin disposed substantially parallel to the pole axis, which is offset from the handle body to form an insertion slot to the hand side or is disposed as an incision in the handle body, wherein the depth of the insertion slot is greater than the width and the thickness of the retaining mandrel or retaining pin.

18. The folding pole according to claim 16, wherein the pole tip comprises a tip body and a buffer, wherein the tip body and/or the lowermost section of the pole body are disposed to pass through a central opening of the buffer and wherein the buffer is displaceably mounted in an axial direction to the pole body in this central opening such that it can be fixed and wherein the buffer can be fixed in at least two axially different positions by means of a positive connection in relation to the pole body, wherein the tip body has a latching link in which latching link a latching body mounted in the buffer can engage positively for fixing the axial position and the latching body is mounted pivotably and/or displaceably and/or fixedly in or on the buffer and wherein the latching body is configured in the form of a latching lever which is hinged on an outer side, wherein the latching lever is hinged on an outer sleeve with a lower end of the latching lever facing an asymmetric rolling surface of the buffer and with an upper end of the latching lever in a fixed position of the buffer at least partially positively embraces the pole pipe and/or an inner sleeve and can be pivoted away from the outer sleeve for releasing.

19. The folding pole according to claim 1, or according to claim 16, wherein the pole handle has a retaining lug for fastening a hand holding device, wherein in a region of the retaining lug displaceable or twistable engaging means are disposed in such a manner that a substantially loop-, ring- or eye-shaped device slid into the retaining lug from above, is fixed in a self-engaging manner in the retaining lug.

20. The folding pole according to claim 1, or according to claim 16, wherein the pole tip comprises a tip body and a buffer, wherein the tip body and/or the lowermost section of the pole body are disposed to pass through a central opening of the buffer and wherein the buffer is displaceably mounted in an axial direction to the pole body in this central opening such that it can be fixed and wherein the buffer can be fixed in at least two axially different positions by means of a positive connection in relation to the pole body.

21. The folding pole according to claim 1, wherein the external clamping device comprises a plastic sleeve which substantially directly embraces the first pipe section at least in an axial section and clamps in the closed state, wherein the plastic sleeve at least in the region embracing the first pipe section has at least one slot making the circumference of the plastic sleeve variable in this region and is configured to be substantially circumferential in the remaining axial region, wherein respectively one projection is disposed on the plastic sleeve on both sides of this slot, wherein these projections have a coaxial through opening disposed substantially perpendicular to the axis of the first pipe section, through which a transverse pin grips, which pin has a stop on the outer side of the second projection and which, on the outer side of the first projection, has an axis of rotation for a clamping lever disposed perpendicular to the axis of the transverse pin and parallel to the axis of the first pipe section, wherein the clamping lever has a lever arm which, when the clamping device is closed, embraces the plastic sleeve at least partially and wherein the clamping lever has an eccentric rolling region about the axis of rotation by which means the distance between the stop and a mating surface for clamping disposed on the outer side of the first projection can be reduced by pivoting the clamping lever into the closed position.

22. The folding pole according to claim 1, wherein the folding pole additionally has a length adjusting mechanism acting by means of force fit for the length adjustment of the pole.

23. The folding pole according to claim 1, wherein the tension cable is fastened to the lowermost pipe section and/or to the uppermost pipe section, by providing an axially fixed retaining element to which the tension cable is fastened, wherein this fastening is variable for an adjustable length of the folding pole, whereby this is achieved, by means of a detachable knot which is brought into contact with the retaining element in the axial direction in the assembled state.

24. The folding pole according to claim 1, wherein the further plug-in connections are configured in such a manner that on one pipe section they have a guide pin provided with an axially running central through opening for the tension cable, which is firmly fastened in this pipe section with a fastening section and axially opposite thereto has a pin region which can be slid into another pipe section, wherein between the fastening section and the pin region there is provided a radially circumferential outwardly directed contact flange which in the assembled state is brought into axial contact with a pipe end of the other pipe section and/or with a pipe closure sleeve provided thereon, wherein this axial stop formed by the contact flange is configured asymmetrically about the pole axis and/or wherein the pin region has an at least partially conically tapering region at its end facing the other pipe section.

25. The folding pole according to claim 1, wherein the pole tip is configured asymmetrically, by fastening a damping buffer which is asymmetric relative to the pole axis in a manner secured against rotation to the pole tip, or wherein the pole handle is configured to be asymmetric relative to the pole axis.

26. The folding pole according to claim 1, wherein the pole handle has a retaining lug for fastening a hand holding device, in the form of a hand loop or a glove, wherein in a region of the retaining lug displaceable or twistable engaging means are disposed in such a manner that a substantially loop-, ring- or eye-shaped device slid into the retaining lug from above, is fixed in a self-engaging manner in the retaining lug, wherein the retaining lug is disposed on the pole handle on the hand side in the upper region, and wherein the retaining lug comprises a retaining mandrel or retaining pin disposed substantially parallel to the pole axis, which is offset from the handle body to form an insertion slot to the hand side or is disposed as an incision in the handle body, wherein the depth of the insertion slot is greater than the width and the thickness of the retaining mandrel or retaining pin.

27. The folding pole according to claim 1, wherein the pole tip comprises a tip body and a buffer, wherein the tip body and/or the lowermost section of the pole body are disposed to pass through a central opening of the buffer and wherein the buffer is displaceably mounted in an axial direction to the pole body in this central opening such that it can be fixed and wherein the buffer can be fixed in at least two axially different positions by means of a positive connection in relation to the pole body, wherein the tip body has a latching link in which latching link a latching body mounted in the buffer can engage positively for fixing the axial position and the latching body is mounted pivotably and/or displaceably and/or fixedly in or on the buffer and wherein the latching body is configured in the form of a latching lever which is hinged on an outer side, wherein the latching lever is hinged on an outer sleeve with the latching lever's lower end facing an asymmetric rolling surface of the buffer and with the latching lever's upper end in a fixed position of the buffer, the latching lever at least partially positively embraces the pole pipe and/or an inner sleeve and can be pivoted away from an outer sleeve for releasing.

28. The folding pole according to claim 1, wherein the external clamping device comprises a plastic sleeve which substantially directly embraces the first pipe section at least in an axial section and clamps in the closed state, wherein the plastic sleeve at least in the region embracing the first pipe section has at least one slot making the circumference of the plastic sleeve variable in this region and is configured to be substantially circumferential in the remaining axial region, wherein respectively one projection is disposed on the plastic sleeve on both sides of this slot, wherein these projections have a coaxial through opening disposed substantially perpendicular to the axis of the first pipe section, through which a transverse pin grips, which pin has a stop on the outer side of the second projection and which, on an outer side of the first projection, has an axis of rotation for a clamping lever disposed perpendicular to the axis of the transverse pin and parallel to the axis of the first pipe section, wherein the clamping lever has a lever arm which, when the clamping device is closed, embraces the plastic sleeve at least partially and wherein the clamping lever has an eccentric rolling region about the axis of rotation by which means the distance between the stop and a mating surface for clamping disposed on the outer side of the first projection can be reduced by pivoting the clamping lever into the closed position, wherein the mating surface is configured in the form of a metal element disposed at least partially in the first projection in a recess and wherein the mating surface is configured as a flat surface or as a concave surface whose radius of curvature is substantially adapted to the radius of curvature of the rolling region and wherein the plastic sleeve has in its upper section at least two axially running slots, wherein at least one of these slots is disposed between the two projections and these slots are distributed uniformly around the circumference and/or wherein the said stop is configured to be adjustable, wherein the stop is configured with a thread and the transverse pin is configured with a counterthread and the stop is configured as a nut or screw, with a circumferential toothed structure and/or a comb and/or a groove for engagement of an adjusting tool.

29. The folding pole according to claim 1, wherein the folding pole additionally has a length adjusting mechanism, in the form of an external clamping mechanism acting by means of force fit for the length adjustment of the pole.

* * * * *